US010895240B2

(12) United States Patent
Kondo

(10) Patent No.: US 10,895,240 B2
(45) Date of Patent: Jan. 19, 2021

(54) IGNITION COIL UNIT

(71) Applicant: DENSO CORPORATION, Kariya (JP)

(72) Inventor: Yuki Kondo, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/688,118

(22) Filed: Nov. 19, 2019

(65) Prior Publication Data

US 2020/0158071 A1 May 21, 2020

(30) Foreign Application Priority Data

Nov. 21, 2018 (JP) ..... 2018-218022

(51) Int. Cl.
*F02P 3/02* (2006.01)
*H01F 38/12* (2006.01)

(52) U.S. Cl.
CPC ..... *F02P 3/02* (2013.01); *H01F 38/12* (2013.01)

(58) Field of Classification Search
CPC ..... F02P 3/02; H01F 38/12
See application file for complete search history.

(56) References Cited

U.S. PATENT DOCUMENTS 4,132,969 A * 1/1979 Hillyard ..... H01F 38/12 336/94
6,873,238 B2 * 3/2005 Kondo ..... F02P 3/02 336/90
7,084,729 B2 * 8/2006 Kondo ..... F02P 3/02 336/90
8,011,354 B2 * 9/2011 Fujiyama ..... H01F 38/12 123/634

FOREIGN PATENT DOCUMENTS

JP 2017-45760 3/2017

* cited by examiner

*Primary Examiner* — Hieu T Vo
(74) *Attorney, Agent, or Firm* — Nixon & Vanderhye PC

(57) ABSTRACT

An ignition coil unit comprises a primary coil, a secondary coil, a housing and a terminal metallic part. A portion of the terminal metallic part is buried in a burying wall formed in the housing. The other portion of the terminal metallic part is disposed in an interior of the housing. The terminal metallic part includes an inner terminal extended from a burying wall main surface and at least partially disposed in the interior of the housing. The inner terminal includes a terminal first portion extended along a normal line of the terminal burying wall main surface from the terminal burying wall main surface to the interior of the housing and a terminal second portion extended upward from the terminal first portion. The housing includes a protrusion to horizontally protrude from the terminal burying wall main surface while facing the bottom surface of the terminal first portion.

7 Claims, 16 Drawing Sheets

IGNITION COIL UNIT

CROSS-REFERENCE TO RELATED APPLICATION

This patent application is based on and claims priority to Japanese Patent Application No. 2018-218022, filed on Nov. 21, 2018 in the Japan Patent Office, the entire disclosure of which is hereby incorporated by reference herein.

BACKGROUND

Technical Field

Embodiments of this disclosure relate to an ignition coil unit.

Related Art

A known ignition coil unit includes a housing for accommodating components thereof, such as a primary coil, a secondary coil, an igniter, etc. The primary coil and the secondary coil are wound around a coil winding axis extended in a lateral direction of the housing. The housing includes an opening opened in a vertical direction thereof. Herein below, when the known coil unit is described, a direction in which an open side of the housing faces in the vertical direction is referred to as an upward direction. A direction in which the opposite side thereto is referred to as a downward direction. One coil axis direction is referred to as a forward direction. Another coil axis direction opposite thereto is referred to as a backward direction.

In the known ignition coil unit, the housing includes a housing body as an essential part and an engagement wall at a front side of the housing body. A part of a terminal metallic part is buried in the engagement wall. The other part of the terminal metallic part protrudes inward to the housing from the engagement wall to serve as an inner terminal. The inner terminal has an L-shape formed by bending a metal plate in a thickness direction thereof. That is, the inner terminal includes a terminal first portion extended in the rear side direction of the coil axis direction from the engagement wall. The inner terminal also includes a terminal second portion upwardly extended in the vertical direction from a rear end of the terminal first portion. The terminal second portion is connected to a terminal of an igniter or the like by welding or a similar manner when assembled.

SUMMARY

An object of the present disclosure is to provide a novel ignition coil unit capable of either suppressing or reducing the deformation of the inner terminal. Accordingly, one aspect of the present disclosure provides a novel ignition coil unit that comprising: a primary coil; a secondary coil magnetically coupled to the primary coil; and an igniter to energize and deenergize the primary coil. The ignition coil unit further comprises a housing to accommodate the primary coil and the secondary coil in an interior thereof. The housing has a terminal burying wall and the terminal burying wall has a terminal burying wall main surface facing to an interior of the housing. The ignition coil unit further comprises a terminal metallic part having a first end buried in the terminal burying wall and a second end disposed in the interior of the housing. The second end is opposite the first end. The terminal metallic part includes at least one inner terminal at least partially arranged in the interior of the housing. The at least one inner terminal includes a terminal first portion extended in a normal line direction of the terminal burying wall main surface from the terminal burying wall main surface toward the interior of the housing. The at least one inner terminal includes a terminal second portion continuously extended from a leading end of the terminal first portion in a first vertical direction along the terminal burying wall main surface. The at least one inner terminal is either press-fit by a terminal of a part installed in the housing or joins the terminal by welding at the terminal second portion. The housing includes at least one protrusion to protrude from the terminal burying wall main surface toward the interior of the housing. The at least one protrusion faces a bottom surface of the at least one terminal first portion in the first vertical direction.

Hence, according to the above-described one embodiment, the housing of the ignition coil unit has the protrusion that protrudes from the terminal burying wall main surface to the interior of the housing while facing the bottom surface of the terminal first portion. Accordingly, even when a load is applied to the inner terminal in an opposite direction to a vertical extension direction, since the bottom surface of the terminal first portion of the inner terminal is supported by the protrusion, deformation of the inner terminal can be suppressed.

As described heretofore, according to the above-described one embodiment, in an ignition coil unit, deformation of an inner terminal can be suppressed.

BRIEF DESCRIPTION OF THE DRAWINGS

A more complete appreciation of the present disclosure and many of the attendant advantages of the present disclosure will be more readily obtained as substantially the same becomes better understood by reference to the following detailed description when considered in connection with the accompanying drawings, wherein.

DETAILED DESCRIPTION

A known ignition coil unit is described, for example, in Japanese Patent Application Laid Open No. 2017-45760 (JP-2017-45760-A). However, when an electronic component such as the igniter, etc., is connected to the terminal second portion, since a downward load is applied to the inner terminal, the inner terminal is likely to be deformed. The present disclosure addresses such a problem, and an object thereof is to provide a novel ignition coil unit capable of either suppressing or reducing the deformation of the inner terminal.

Figure 1:
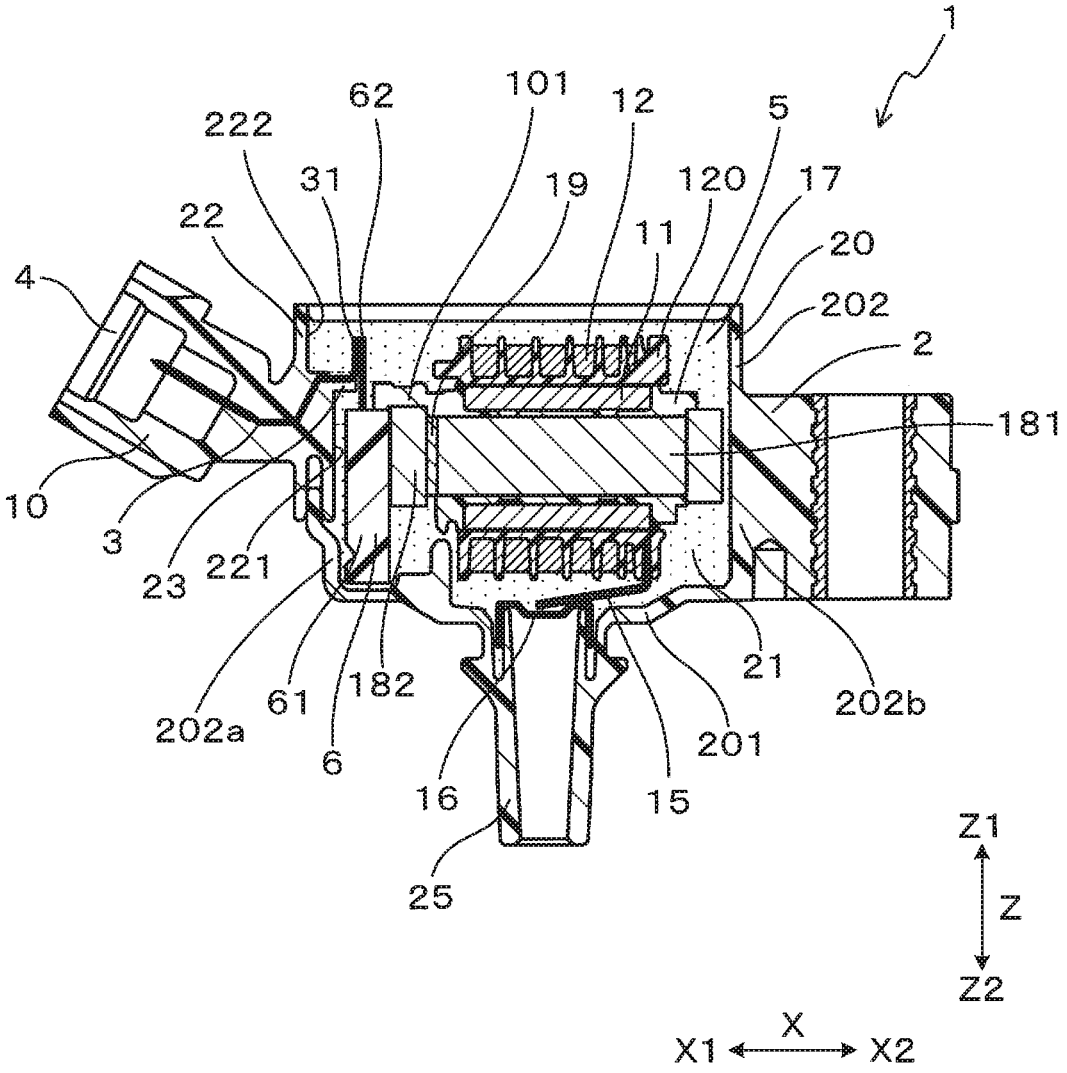
FIG. 1 is a vertical cross-sectional view illustrating an ignition coil unit according to a first embodiment of the present disclosure.

Referring now to the drawings, wherein like reference numerals designate identical or corresponding parts throughout the several views thereof, in particular to FIGS. 1 to 4, a first embodiment of an ignition coil unit is herein below described. As shown in FIG. 1, the ignition coil unit 1 of this embodiment includes a primary coil 11, a secondary coil 12, a housing 2 and a terminal metallic part 3. The primary coil 11 and the secondary coil 12 are magnetically coupled to each other. The housing 2 accommodates the primary coil 11 and the secondary coil 12 in its interior 21. A portion of the terminal metallic part 3 is buried in a terminal burying wall 22 formed in the housing 2. The other portion of the terminal metallic part 3 is disposed in the interior 21 of the housing 2.

Figure 2:
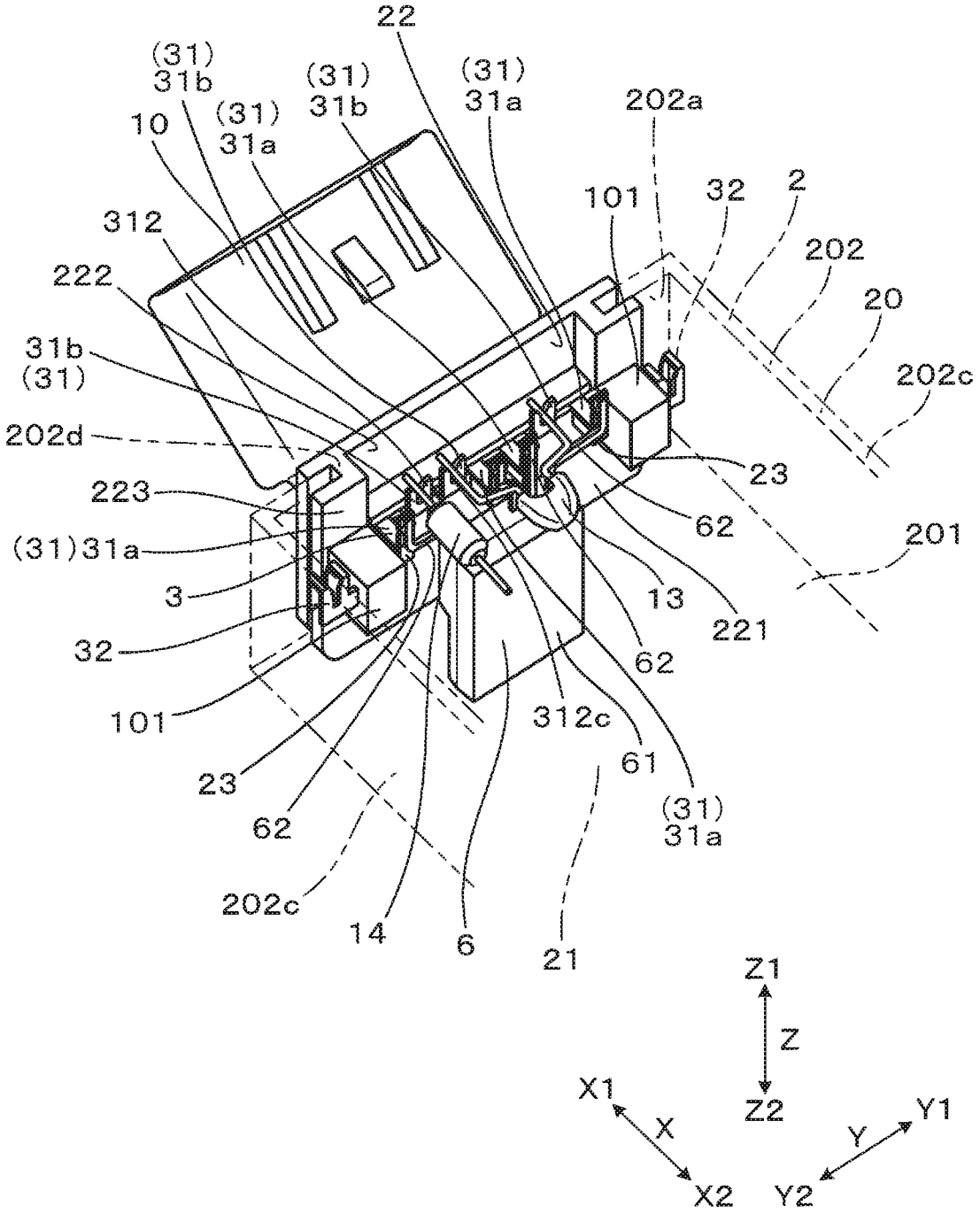
FIG. 2 is a perspective view illustrating a connector unit, a terminal metallic part, an igniter, a capacitor and a diode according to the first embodiment of the present disclosure.
Figure 3:
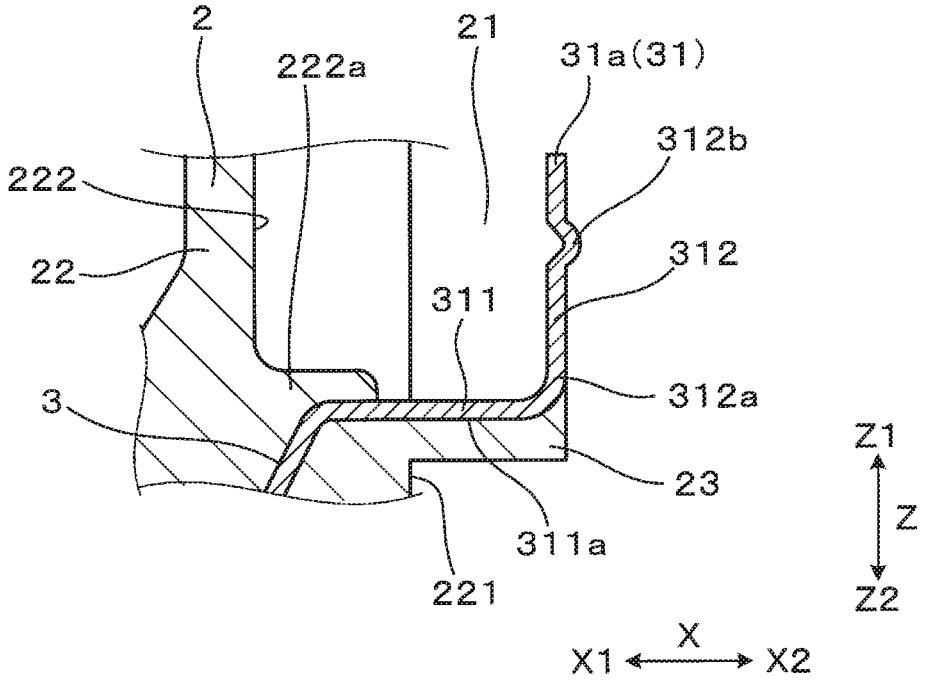
FIG. 3 is an enlarged cross-sectional view illustrating a protrusion and a periphery thereof included in the ignition coil unit according to the first embodiment of the present disclosure.

As shown in FIGS. 1 to 3, the terminal metallic part 3 is more deeply extended in the housing 2 than a terminal burying wall main surface 221 that acts as a main surface facing an interior of the housing 2 on the terminal burying wall 22. The terminal metal part 3 also includes an inner terminal 31 at least partially disposed in the interior 21 of the housing 2.

As shown in FIG. 3, the inner terminal 31 is composed of a terminal first portion 311 and a terminal second portion 312. The terminal first portion 311 is extended along a normal line X of the terminal burying wall main surface 221 from the terminal burying wall main surface 221 to the interior of the housing 2. The terminal second portion 312 is extended downstream in an extension direction i.e., a Z1 direction along a vertical axis Z from the terminal first portion 311 along the terminal burying wall main surface 221.

Herein below, the normal line X perpendicular to the terminal burying wall main surface 221 is simply referred to as the normal line X. A direction along the normal line X in which the terminal burying wall main surface 221 is located upstream is herein below simply referred to as a X2 direction. An opposite direction thereto is simply referred to as an X1 direction. Further, an extension direction Z1 along a vertical axis Z is herein below simply referred to as a Z1 direction. An opposite direction thereto is herein below simply referred to as a Z2 direction. Further, an axis perpendicular to both the normal line X and the vertical axis Z is herein below simply referred to as a lateral axis Y. A direction along the lateral axis Y is herein below simply referred to as a Y1 direction. An opposite direction thereto is simply referred to as a Y2 direction.

As shown in FIG. 3, the housing 2 includes a protrusion 23 that protrudes in the X2 direction from the terminal burying wall main surface 221 while facing a bottom surface 311*a* (i.e., a surface facing to the Z2 direction) of the terminal first portion 311. Hereinbelow, this embodiment of the present disclosure is described more in detail.

The ignition coil unit 1 is used in an internal combustion engine. For example, the ignition coil unit 1 is connected to a spark plug (not shown) installed in an internal combustion engine mounted on an automobile and a cogeneration or the like, and is used as a device for applying a high voltage to the spark plug.

As shown in FIGS. 1 and 2, the housing 2 includes a housing body 20 and a terminal burying wall 22 attached to the housing body 20. Since the housing body 20 and the terminal burying wall 22 are separate from each other, the housing 2 needs to be built by assembling the housing body 20 and the terminal burying wall 22.

As shown in FIG. 1, the housing body 20 is a box state opened downstream in the Z1 direction. The housing body 20 includes a bottom wall 201 having a rectangular plate-like shape extended horizontally (perpendicular to the vertical axis Z). The housing body 20 also includes a peripheral wall 202 erected from a periphery edge of the bottom wall 201 in the Z1 direction. The peripheral wall 202 is substantially rectangular cylindrical. The peripheral wall 202 of the housing body 20 is opened downstream in the Z1 direction.

As shown in FIGS. 1 and 2, the peripheral wall 202 is composed of a peripheral wall front portion 202*a* and a peripheral wall rear portion 202*b* facing each other along the normal line X. The peripheral wall 202 is also composed of a pair of peripheral wall side portions 202*c* facing each other along the lateral axis Y. The peripheral wall front portion 202*a* is disposed downstream of the peripheral wall rear portion 202*b* in the X1 direction. Hence, the housing body 20 is composed of these five walls of the peripheral wall front portion 202*a*, the peripheral wall rear portion 202*b*, the pair of peripheral wall side portions 202*c* and the terminal burying wall 22. Here, the terms of front and rear are herein below used for the purpose of convenience and do not limit, for example, a posture of the ignition coil unit 1 mounted on the vehicle.

To receive the terminal burying wall 22, The peripheral wall front portion 202*a* has a peripheral wall recess 202*d* as a cutout almost at its center along the lateral axis Y and extended along the vertical axis Z. Hence, the terminal burying wall 22 fits into the peripheral wall recess 202*d* as shown.

As shown in FIG. 2, the terminal burying wall 22 is a rectangular plate having a given thickness along the normal line X. The terminal burying wall 22 has a groove 223 continuously formed over its respective edges in the lateral directions Y1 and Y2 and an edge in the Z2 direction. Hence, the terminal burying wall 22 is engaged with the peripheral wall recess 202*d* with the peripheral wall recess 202*d* inserted into the groove 223.

As shown in FIG. 1, the terminal burying wall 22 is integrally molded together with a connector 4 and a primary spool 5 as described later more in detail. Herein below, a member integral with the terminal burying wall 22, the connector 4 and the primary spool 5 is referred to as a connector unit 10. The connector unit 10 is prepared by inserting a terminal metallic part 3 and a center core 181 described later in detail into a mold thereby executing insert molding.

As shown in FIG. 1, the connector 4 protrudes in the X1 direction from a surface of the terminal burying wall 22 facing to the X1 direction. The connector 4 has a bottomed cylindrical shape. The connector 4 increasingly inclines to the Z1 direction as it extends in the X1 direction thereby obliquely opening between these two directions. Into an inner space of the connector 4, a portion of the terminal metallic part 3 protrudes. To the connector 4, an external connector (not shown) disposed out of the ignition coil unit 1 is connected. As the external connector, a connector provided at one end of a wire harness connected to an external instrument such as a controller, etc., disposed outside the ignition coil unit 1 via the other end of the wire harness is exemplified.

As shown in FIGS. 1 and 2, the terminal burying wall 22 has a terminal burying wall recess 222 recessed in the X1 direction from the terminal burying wall main surface 221 acting as a main surface thereof facing to the X2 direction. As shown in FIG. 2, the terminal burying wall recess 222 is disposed along the lateral axis Y between the grooves 223 disposed at the respective ends of the terminal burying wall 22. Further, the terminal burying wall recess 222 is located in a region of the terminal burying wall 22 facing to the Z1 direction. The terminal burying wall recess 222 is extended until the end of the terminal burying wall 22 in the Z1 direction and is opened there. Further, as shown in FIG. 3, an edge of a side end 222*a* of the terminal burying wall recess 222 facing to both the Z2 and X2 directions is slightly offset (i.e., dented) from the terminal burying wall main surface 221 in the X1 direction.

Further, as shown in FIGS. 1 and 2, the terminal burying wall main surface 221 of the terminal burying wall 22 is located in the housing 2 perpendicular to the normal line axis X at the endmost in the X2 direction among portions of the terminal burying wall 22 except for the protrusion 23. As shown, the terminal burying wall main surface 221 is located in the terminal burying wall 22 other than the terminal burying wall recess 222.

Here, in this specification, a main surface among surfaces means a surface if the number of surfaces is one. If the surface is composed of multiple pieces, the main surface means a piece having the widest area among multiple pieces.

Further, in the terminal burying wall 22, multiple terminal metallic parts 3 are buried. A part of at least one of multiple terminal metallic parts 3 is exposed to the inner space of the connector 4. Specifically, in the inner space of the connector 4, terminals of three terminal metallic parts 3 are exposed. These three terminals exposed to the interior of the connector 4 may be composed of a ground terminal grounded through a wire harness or the like connected to the connector 4, a power supply terminal for connecting an external power supply with the primary coil 11 and a signal terminal for transmitting a switching signal to the igniter 6.

Further, as shown in FIGS. 1 to 3, each of the multiple terminal metallic parts 3 is partially exposed to the interior of the housing 2. Among these terminal metallic parts 3, at least a part of the multiple terminals exposed to the interior of the housing 2 is the inner terminal 31. As shown in FIG. 3, the inner terminal 31 is a portion of the terminal metallic part 3 extended in the X2 direction from the terminal burying wall main surface 221 with the above-described terminal first portion 311 and the terminal second portion 312.

Specifically, as shown in FIG. 3, the terminal first portion 311 is extended in the X2 direction along the normal line X from the terminal burying wall main surface 221. The terminal second portion 312 is extended in the Z1 direction from the terminal first portion 311 along the vertical axis Z. When viewed from the lateral direction Y, the inner terminal 31 shows an L-shape. That is, the inner terminal 31 is prepared by bending an elongated plate-like member in its thickness direction.

Further, at a boundary between the terminal first portion 311 and the terminal second portion 312, a curved bend 312*a* is provided. This appears when the metal plate constituting the terminal metallic part 3 is bent to prepare the inner terminal 31. As shown, the bend 312*a* is a part of the terminal second portion 312 (i.e. an end of the terminal second portion 312 in the Z2 direction).

As shown in FIG. 2, in this embodiment, the ignition coil unit 1 includes seven inner terminals 31. Four of the seven inner terminals 31 are long terminals 31*a* and the remaining three are short terminals 31*b*. The long terminal 31*a* includes a terminal first portion 311 extended along the normal line X and is longer than the terminal first portion 311 of the short terminal 31*b*. Accordingly, an end of the terminal second portion 312 of the long terminal 31*a* is deeply (further) located in the X2 direction than that of the terminal second portion 312 of the short terminal 31*b*.

Since the terminal first portion 311 of the short terminal 31*b* is shorter along the normal line X than the terminal first portion 311 of the long terminal 31*a*, the short terminal 31*b* is more rigid than the long terminal 31*a*, and accordingly, rarely deforms even if a given amount load is applied thereto. These seven inner terminals 31 of the long terminal 31*a*, the short terminal 31*b*, the long terminal 31*a*, the short terminal 31*b*, the long terminal 31*a*, the short terminal 31*b* and the long terminal 31*a* are arranged in this order in the Y2 direction.

Further, as shown in FIGS. 1 and 2, to the terminal second portion 312 of the long terminal 31*a*, an igniter terminal 62 described later in detail is connected. Specifically, as shown in FIG. 3, a projection 312*b* is formed almost at a center of the terminal second portion 312 of the long terminal 31*a* as a bend to protrude downstream in the X2 direction.

Hence, when the long terminal 31*a* and the igniter terminal 62 are connected to each other, the ignitor terminal 62 is firstly placed to face the X2 side of the terminal second portion 312 of the long terminal 31*a* along the normal line X. Then, the projection 312*b* of the terminal second portion 312 is pressed against the ignitor terminal 62 and the long terminal 31*a* and the igniter terminal 62 are joined by resistance welding. Thus, the terminal second portion 312 and the igniter terminal 62 are joined near the projection 312*b*. That is, the long terminal 31*a* serves as a so-called welding terminal.

Figure 6:
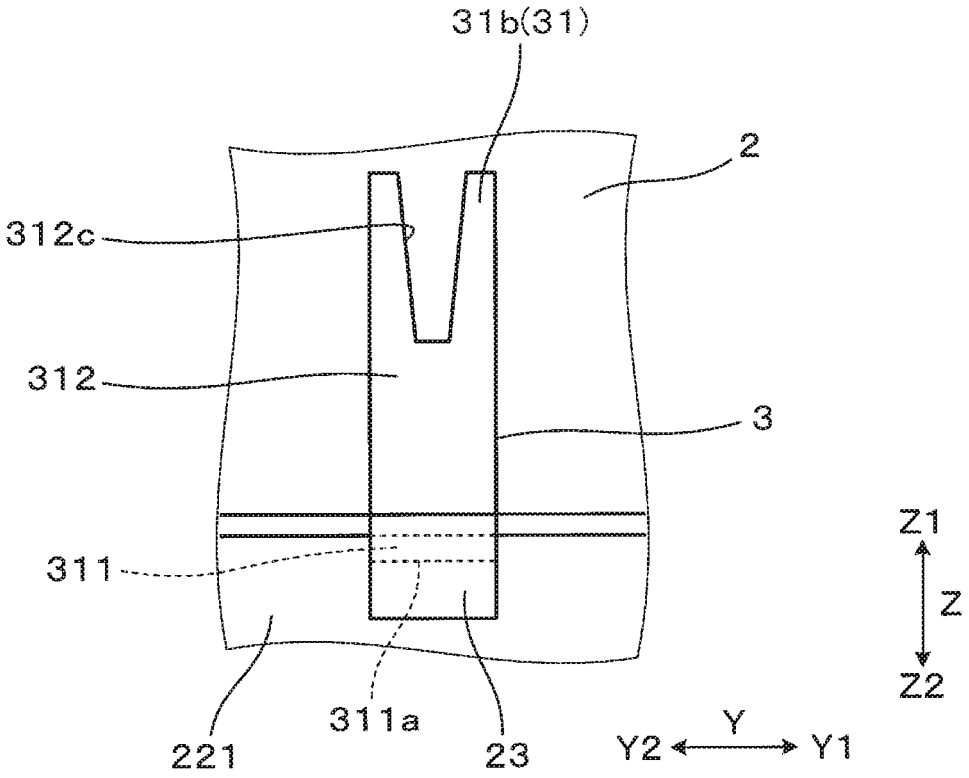
FIG. 6 is an enlarged view illustrating the protrusion and the periphery of the ignition coil unit according to the modification of the first embodiment.

Further, as shown in FIGS. 2 and 6, the short terminal 31*b* includes a slit 312*c* prepared by cutting out the terminal second portion 312 in the Z2 direction from an edge thereof. Hence, since a terminal is press-fit into the slit 312*c* of the short terminal 31*b*, the terminal is connected to the short terminal 31*b*. That is, the short terminal 31*b* serves as a so-called press-fitting terminal.

Further, as shown in FIG. 2, into an endmost short terminal 31*b* aligning in the Y1 direction among the three short terminals 31*b*, a terminal of a capacitor 13 is press-fit. Also, into a short terminal 31*b* located at a center among the three short terminals 31*b* along the lateral axis Y, the other terminal of the capacitor 13 is press-fit. The terminal of the capacitor 13 is connected to a ground terminal provided in the connector 4 via the short terminal 31*b*. The other terminal of the capacitor 13 is connected to a power supply terminal provided in the connector 4 via the short terminal 31*b*.

Further, as shown in FIG. 2, to an endmost short terminal 31*b* aligning in the Y2 direction among the three short terminals 31*b*, a terminal of a diode 14 is connected. The diode 14 is provided, for example, to suppress a voltage generated in the secondary coil 12 when the primary coil 11 is energized. One end of the diode 14 is electrically connected to either the power supply terminal or the ground terminal disposed in the interior of the connector 4 via the short terminal 31*b*. The other end of the diode 14 is connected to a low-voltage side end of the secondary coil 12.

Further, as shown in FIG. 2, portions of the capacitor 13 and the diode 14 respectively connected to the short terminals 31*b* align along the normal line X. As understood from FIGS. 1 and 2, both the capacitor 13 and the diode 14 are disposed in the interior 21 of the housing 2 downstream of a linking section 101 constituting the connector unit 10 in the Z1 direction. The linking section 101 is configured to link the terminal burying wall 22 and the primary spool 5 together.

Figure 4:
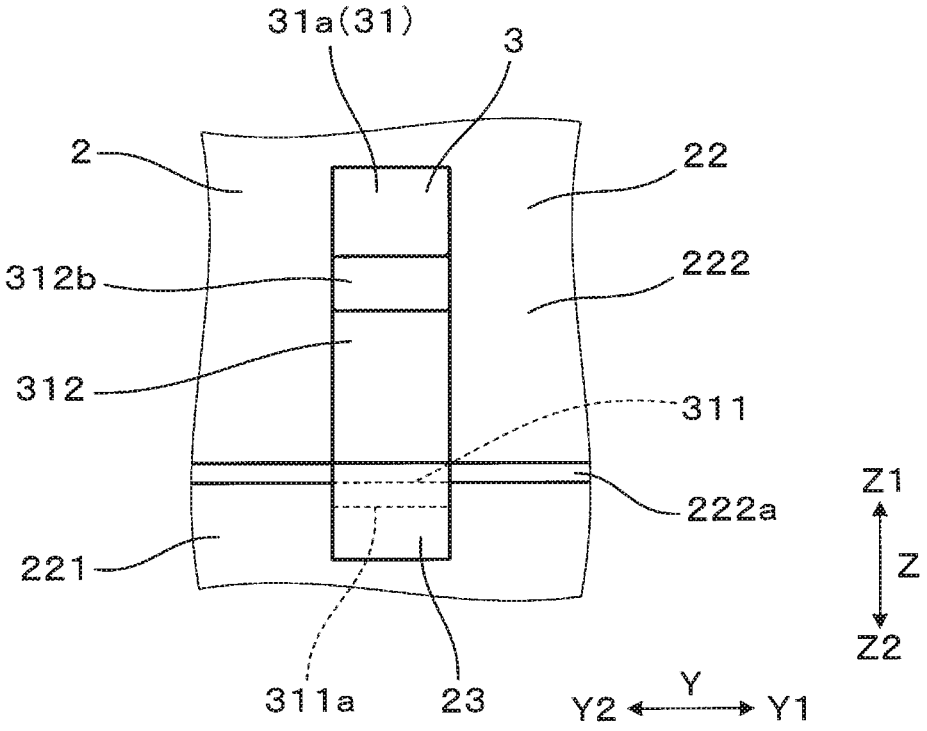
FIG. 4 is an enlarged view illustrating the protrusion and the periphery thereof included in the ignition coil unit according to the first embodiment of the present disclosure.

Further, as shown in FIGS. 2 to 4, the terminal first portion 311 of each of the inner terminals 31 protrudes in the X2 direction from an end of the terminal burying wall main surface 221 in the Z1 direction.

In this embodiment, four protrusions 23 are provided in the housing 2 to face bottom surfaces 311*a* of the four long terminals 31*a*, respectively. That is, the protrusions 23 are arranged to face the bottom surfaces 311*a* of the long terminals 31*a* of the inner terminals 31 having the longer terminal first portions 311 along the normal line X, respectively, among the multiple inner terminals 31. That is, the protrusions 23 are neither disposed nor opposed to the bottom surface 311*a* of the respective short terminals 31*b*. Herein after, since each of the four protrusions 23 includes the substantially same structure in this embodiment, only one protrusion 23 and an inner terminal 31 having a bottom surface 311*a* facing the protrusion 23 are typically described unless otherwise specified when the protrusion 23 is described.

Further, as shown in FIGS. 2 and 3, in the housing 2, the protrusion 23 protrudes from the terminal burying wall main surface 221 in the X2 direction. The protrusion 23 is molded at the same time the connector unit 10 is molded. That is, the connector unit 10 integrally includes the protrusions 23.

As shown in FIGS. 2 and 3, the protrusion 23 faces at least an end of the bottom surface 311*a* of the terminal first portion 311 in the X2 direction. In this embodiment, the entire portion of the protrusion 23 is opposed along the vertical axis Z to the bottom surface 311*a* of the long terminal 31*a*. However, the present disclosure is not limited to a system in which the entire protrusion overlaps with the bottom surface 311*a* of the long terminal 31*a* along the vertical axis Z. That is, the present disclosure includes a system in which substantially the entire protrusion 23 overlaps with the bottom surface 311*a* of the long terminal 31*a* along the vertical axis Z even if a portion of the protrusion 23 does not face the bottom surface 311*a* of the long terminal 31*a* along the vertical axis Z due to a tolerance or the like.

Further, the protrusion 23 can face the bottom surface 311*a* of the terminal first portion 311 in various manners. For example, the protrusion 23 can either closely contact the bottom surface 311*a* of the terminal first portion 311 or face the same via a small gap. Here, the small gap means that the gap between the protrusion 23 and the bottom surface 311*a* of the terminal first portion 311 is small enough to the extent that when the inner terminal 31 is about to deflect upon receiving a load applied in the Z2 direction, the bottom surface 311*a* of the terminal first portion 311 of the inner terminal 31 can abut on the protrusion 23.

As shown in FIG. 3, the protrusion 23 extends beyond the end of the terminal first portion 311 in the X2 direction. That is, in this embodiment, the end of the protrusion 23 extends in the X2 direction until an outer surface of the terminal second portion 312 except for the projection 312*b* projecting in the X2 direction.

Further, as shown in FIG. 3, a surface facing to the Z1 direction at the end of the protrusion 23 extended in the X2 direction is curved to follow a surface of the bend 312*a* of the terminal second portion 312 facing to the Z2 direction. The entire surface of the protrusion 23 facing to the Z1 direction is almost opposed to the bottom surface 311*a* of the terminal first portion 311.

As shown in FIG. 4, a width of the protrusion 23 along the lateral axis Y is equivalent to a width of the bottom surface 311*a* of the terminal first portion 311 along the lateral axis Y. Further, as shown in FIG. 3, a thickness of the protrusion 23 along the vertical axis Z is greater than a thickness of the terminal first portion 311 along the vertical axis Z. Further, as shown in FIG. 2, the protrusion 23 is disposed downstream of (i.e., higher than) the igniter body 61 in the Z1 direction along the vertical axis Z.

Further, as shown in FIGS. 1 and 2, a pair of linking sections 101 is provided in the connector unit 10 to connect the terminal burying wall 22 and a primary spool 5 with each other. The linking sections 101 are linearly extended in the X2 direction along the normal line X from respective side ends of a terminal burying wall main surface 221 arranged along the lateral axis Y. The pair of linking sections 101 is respectively located along the lateral axis Y outside of the seven inner terminals 31.

Further, as shown in FIG. 2, from each of the linking sections 101, a wire connection terminal 32 protrudes in an opposite direction along the lateral axis Y. Although not illustrated, to one of the wire connection terminals 32, one end of the primary coil 11 is connected. To the other one of the wire connection terminals 32, the other end of the primary coil 11 is connected as well.

The wire connection terminal 32 facing to the Y1 direction is connected to the endmost inner terminal 31 among the seven inner terminals 31 arranged in the Y1 direction through respective insides of the linking sections 101 and the terminal burying wall 22. A terminal metallic part 3 having the endmost inner terminal 31 among the seven inner terminals 31 arranged in the Y1 direction and the wire connection terminal 32 facing to the Y1 direction is not exposed to the inner space of the connector 4. Further, each of the remaining six inner terminals 31 other than the endmost inner terminal 31 in the Y1 direction among the seven inner terminals 31 is electrically connected to any one of the terminals (i.e., the ground terminal, the power supply terminal or the signal terminal) disposed in the inner space of the connector 4 through an inside of the terminal burying wall 22. The wire connection terminal 32 facing to the Y2 direction is electrically connected to the ground terminal located in the inner space of the connector 4 through respective insides of the linking sections 101 facing to the Y2 direction and the terminal burying wall 22.

Further, as shown in FIG. 1, the primary spool 5 includes openings at both sides along the normal line X thereby having a cylindrical shape. A primary coil 11 is wound around an outer peripheral surface of the primary spool 5. Around an outer periphery of the primary spool 5, a secondary spool 120 is disposed and allows a secondary coil 12 to wind therearound.

As shown in FIG. 1, the secondary spool 120 is separated from the connector unit 10. The secondary spool 120 also includes openings at its both sides along the normal line X thereby having a cylindrical shape again. The primary spool 5 of the connector unit 10 is inserted into the secondary spool 120. The secondary coil 12 is wound around the outer periphery of the secondary spool 120. A low-voltage side of the secondary coil 12 is connected to one end of the diode 14. A high-voltage side of the secondary coil 12 is connected to a high-voltage terminal 16 described later in detail via a connection terminal 15 fitting into the secondary spool 120.

Further, as shown in FIG. 1, the high-voltage terminal 16 is fit into an end of the high-voltage tower 25 facing to the Z1 direction. The high-voltage tower 25 protrudes in the Z2 direction from a bottom wall 201 of the housing body 20. Both sides of the high-voltage tower 25 along the vertical axis Z is opened. A high-voltage terminal 16 is fit into the opening of the high-voltage tower 25 facing on the Z1 direction to cover the opening.

As shown in FIG. 1, the high-voltage terminal 16 functions as an output terminal to output a high voltage from the ignition coil unit 1. The high-voltage terminal 16 also functions as a plug to prevent filling resin 17 filled in the housing 2 having thermosetting property from leaking from the high-voltage tower 25 to an outside of the housing 2. In the high-voltage tower 25, a resistor may be disposed to inhibit noise current from flowing from a spark plug connected to the ignition coil unit 1.

Further, as shown in FIG. 1, a center core 181 is buried in the primary spool 5. Specifically, by setting the center core 181 to an interior of a mold and molding the connector unit 10 using an insert molding method, the center core 181 is buried in the primary spool 5.

Further, as shown in FIG. 1, around the center core 181, an outer peripheral core 182 is disposed. The outer peripheral core 182 has a rectangular annular shape to surround respective both sides of the center core 181 in directions along the lateral axis Y and the normal line X. Each of the center core 181 and the outer peripheral core 182 is made of soft magnetic material and collectively constitute a magnetic path for a magnetic flux generated when the primary coil 11 is energized and deenergized.

Further, as shown in FIG. 1, between a surface of the center core 181 facing to the X1 direction and the outer peripheral core 182, a magnet body 19 is disposed. The magnet body 19 applies a magnetic bias to the center core 181 to enhance an output voltage of the primary coil 11 thereby increasing an amount of change in magnetic flux and a voltage induced in the secondary coil 12 when the primary coil 11 is deenergized.

Further, as shown in FIGS. 1 and 2, the igniter 6 is disposed downstream of the outer peripheral core 182 in the X1 direction. The igniter 6 energizes and deenergizes the primary coil 11. The igniter 6 includes an igniter body 61 prepared by molding a switching element with resin. The igniter 6 also includes four igniter terminals 62 projecting from the igniter body 61 in the Z1 direction. These four igniter terminals 62 are connected to different long terminals 31*a*, respectively.

Further, as shown in FIG. 1, to the interior 21 of the housing 2, filling resin 17 is supplied to seal components of the ignition coil unit 1 disposed in the interior 21. The filling resin 17 is made of epoxy resin, for example.

Now, various advantages obtainable in this embodiment of the present disclosure are herein below described. According to this embodiment, the housing 2 of the ignition coil unit 1 includes the protrusion 23 that protrudes from the terminal burying wall main surface 221 in the X2 direction along the lateral axis X. At the same time, the protrusion 23 faces the bottom surface 311*a* of the terminal first portion 311. Hence, even when a load is applied to the inner terminal 31 in the Z2 direction along the vertical axis Z from above, since the bottom surface 311*a* of the terminal first portion 311 of the inner terminal 31 is supported by the protrusion 23, deformation of the inner terminal 31 can be suppressed.

Further, the protrusion 23 protrudes in the X2 direction from a portion of the terminal burying wall main surface 221 of the housing 2. Hence, by extending the protrusion 23 from the terminal burying wall 22 of the housing 2, the interior 21 of the housing 2 is rarely narrowed.

Further, the protrusion 23 is arranged facing the bottom surface 311*a* of the welding terminal acting as the inner terminal 31. Then, the welding terminal and the igniter terminal 62 are connected to each other by applying resistance welding thereto while almost mutually superposing the terminal second portion 312 and the igniter terminal 62. Hence, when the terminal second portion 312 as the welding terminal and the igniter terminal 62 are either fixed or superposed or the like, there is a risk in that a force is applied in the Z2 direction from the terminal second portion 312 to the welding terminal. Hence, according to this embodiment, since the protrusion 23 faces the bottom surface 311*a* of the welding terminal, the welding terminal can be inhibited from deforming even when the resist welding is performed to join the welding terminal and the igniter terminal 62 together.

Further, the protrusion 23 faces at least the end of the bottom surface 311*a* of the terminal first portion 311 facing to the X2 direction. Thus, since the protrusion 23 at least faces the end of the bottom surface 311*a* of the terminal first portion 311 furthest from the terminal burying wall main surface 221, deformation of the terminal first portion 311 can be more effectively inhibited.

Further, the protrusion 23 only faces the bottom surface 311*a* of the long terminal 31*a*, but it does not face the bottom surface 311*a* of the short terminal 31*b*. That is, the protrusion 23 is only opposed to the bottom surface 311*a* of the long terminal 31*a* likely to deform due to a length of the terminal first portion 311. However, the protrusion 23 is not opposed to the bottom surface 311*a* of the short terminal 31*b* unlikely to deform due to a length of the terminal first portion 311. Thus, the number of protrusions 23 can be reduced while suppressing deformation of the long terminal 31*a*. At the same time, a mold for molding a member integral with a protrusion 23 (i.e., the connector unit 10 in this embodiment) can be simplified.

As described heretofore, according to this embodiment, deformation of the inner terminal of the ignition coil unit can be suppressed.

Figure 5:
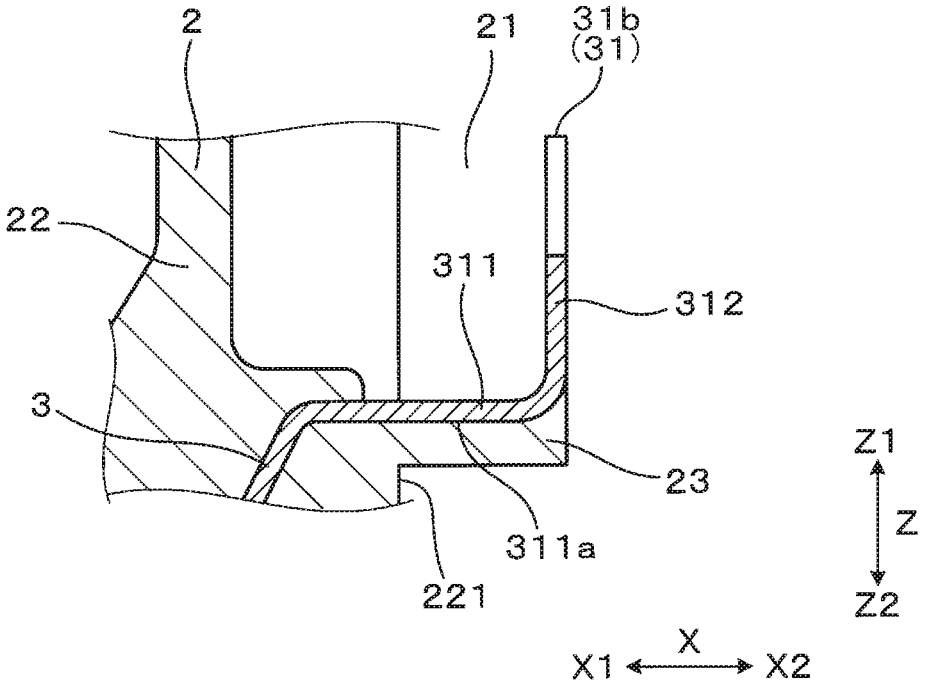
FIG. 5 is an enlarged cross-sectional view illustrating a protrusion and a periphery thereof included in an ignition coil unit according to a modification of the first embodiment.

Further, beside the embodiment in that the protrusion 23 is located to face the bottom surface 311*a* of the weld terminal, the protrusion 23 can also be provided to face the bottom surface 311*a* of the pressure contact terminal as shown in FIGS. 5 and 6.

Figure 7:
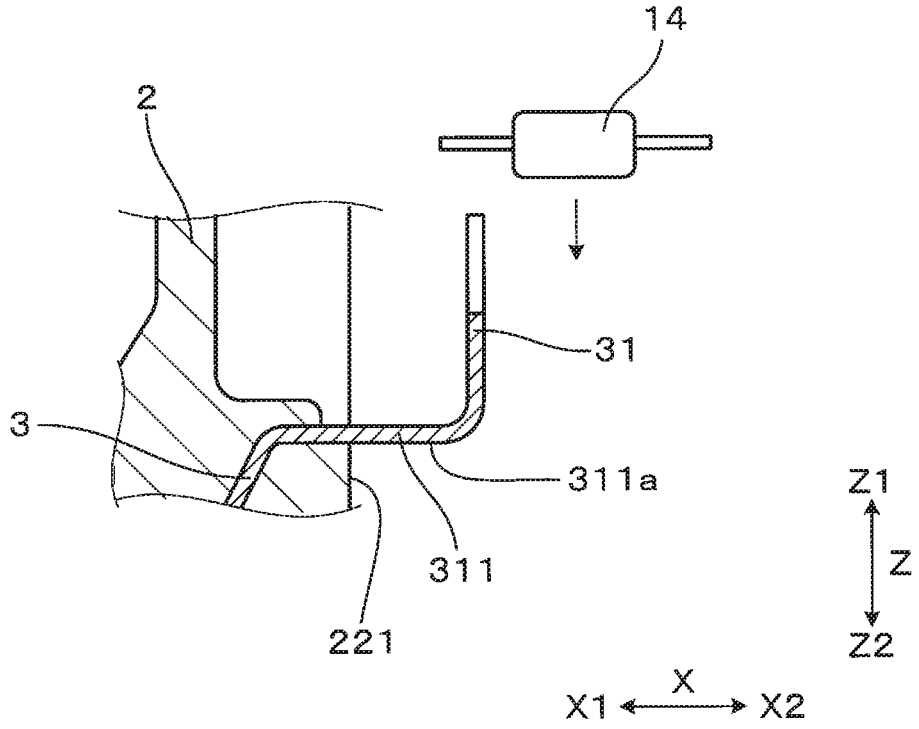
FIG. 7 is an enlarged cross-sectional view illustrating a pressure contact terminal and a periphery thereof included in the ignition coil unit before the diode press-fits into a short terminal according to a comparative example.
Figure 8:
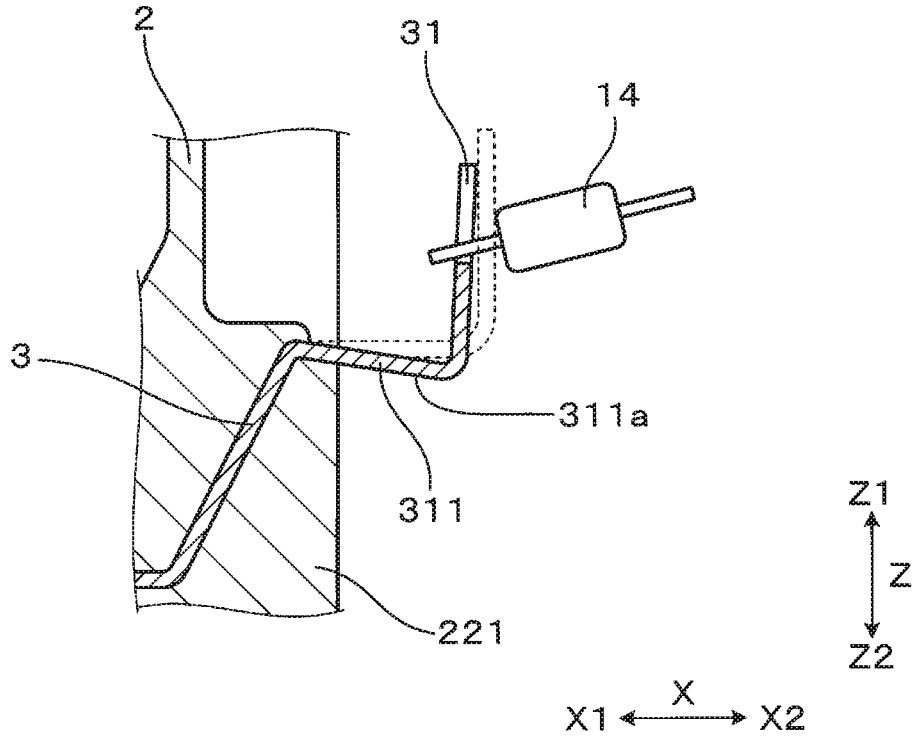
FIG. 8 an enlarged view illustrating the pressure contact terminal and the periphery thereof included in the ignition coil unit when the diode has press fit into the pressure contact terminal and the inner terminal is deformed according to the comparative example.

That is, the terminal of the diode 14 or the like is press-fit into the slit 312*c* of the pressure contact terminal in the Z1 direction. Hence, as shown in FIGS. 7 and 8, when the protrusion is absent and the terminal of the diode 14 or the like is press-fit into the slit 312*c* of the pressure contact terminal, the pressure contact terminal has a risk of deforming in the Z2 direction as shown in FIG. 8, because a force is applied to the pressure contact terminal in the Z2 direction.

Hence, as shown in FIGS. 5 and 6, when a protrusion 23 is provided to face the bottom surface 311*a* of the pressure contact terminal, the pressure contact terminal can rarely deform even when a terminal of the capacitor 13 or the diode 14 and the like is press-fit into the slit 312*c* of the pressure contact terminal. Hence, deformation of the pressure contact terminal can be suppressed even if the terminal first portion 311 of the pressure contact terminal is relatively lengthened.

Figure 9:
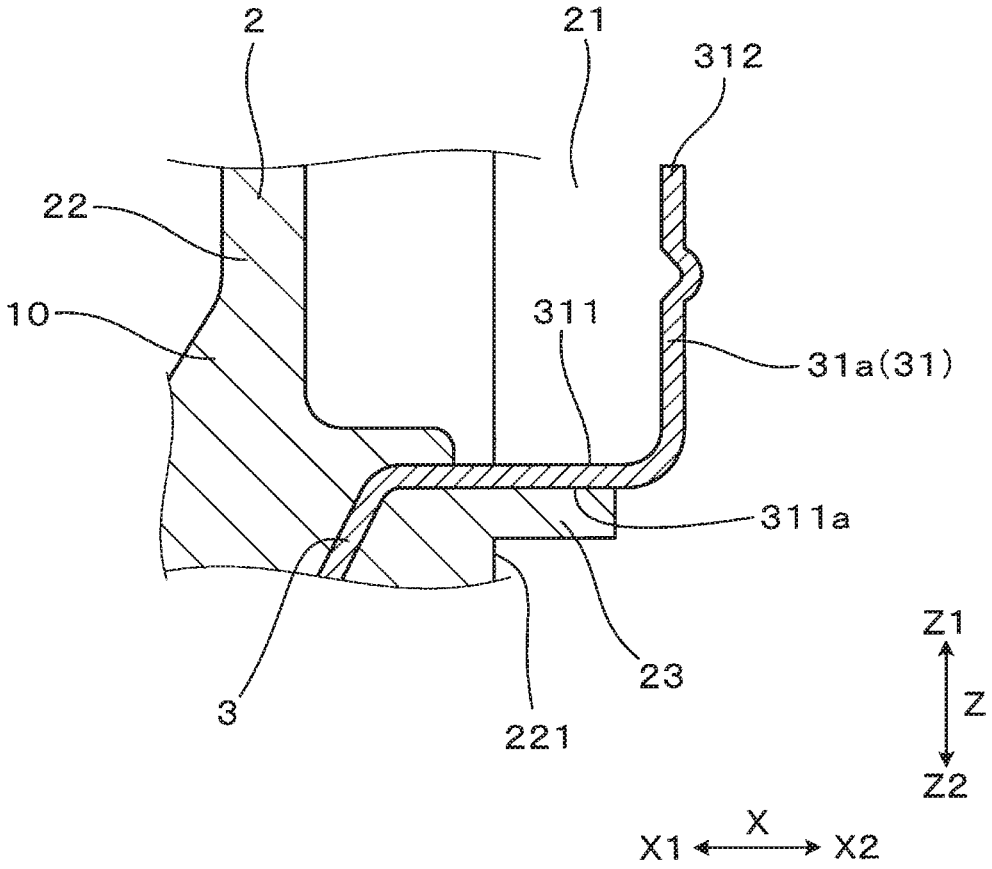
FIG. 9 is an enlarged cross-sectional view illustrating a protrusion and a periphery thereof included in an ignition coil unit according to a second embodiment of the present disclosure.

Now, a second embodiment of the present disclosure is described with reference to FIG. 9 and applicable drawings. As shown in FIG. 9, the first embodiment is modified and employed in this embodiment by changing a length of the protrusion 23 along the normal line X.

That is, in this embodiment, the end of the protrusion 23 in the X2 direction is located downstream of the terminal second portion 312 in the X1 direction. In other words, the protrusion 23 does not protrude in the X2 direction from the end of the terminal first portion 311 facing to the X2 direction. More specifically, the end of the protrusion 23 in the X2 direction is shifted slightly in the X1 direction from the end of the terminal first portion 311 facing to the X2 direction (i.e. the end of the bend 312*a* of the terminal second portion 312). The ignition coil unit 1 of this embodiment includes at least one protrusion 23 described heretofore.

Remaining configurations are substantially the same as in the first embodiment.

As described heretofore, according to this embodiment, since the protrusion 23 does not protrude from the terminal first portion 311 in the X2 direction, the length of the protrusion 23 in a protruding direction (i.e. along the normal line X) can be shortened. As a result, strength of the protrusion 23 can be effectively secured. Further, when the protrusion 23 is integrally molded together with the connector unit 10, a short shot can be avoided thereby producing a satisfactory protrusion 23. Remaining advantages obtained in this embodiment can be substantially the same as obtained in the first embodiment.

Figure 10:
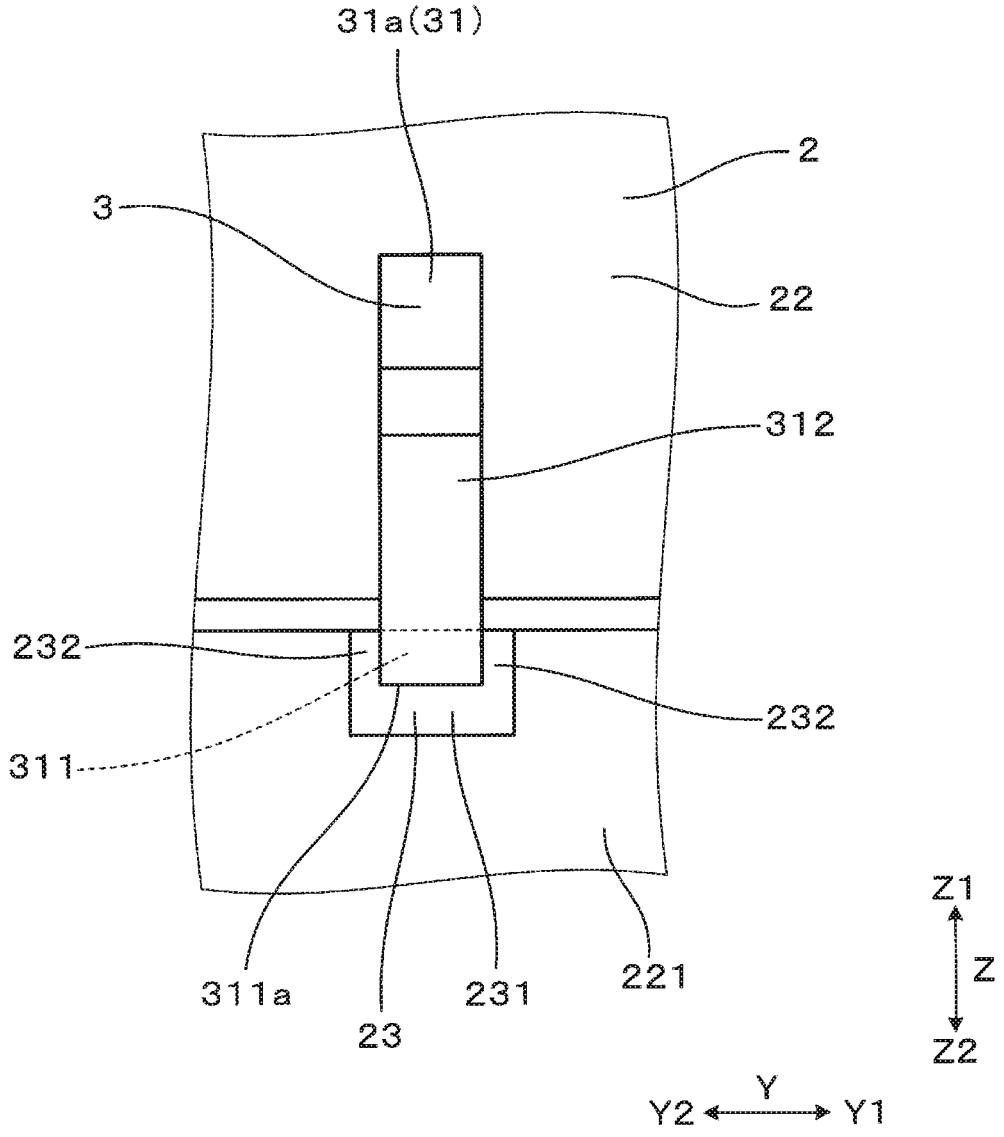
FIG. 10 is an enlarged view illustrating a protrusion and a periphery thereof included in an ignition coil unit according to a third embodiment of the present disclosure.

Now, a third embodiment of the present disclosure is described with reference to FIG. 10 and applicable drawings. As shown in FIG. 10, the second embodiment is modified and employed in this embodiment by changing a dimension of the protrusion 23 along the lateral axis Y.

Specifically, in this embodiment, a protrusion 23 has a U-shape like cross-section perpendicular to the normal line X. More specifically, in the cross-sectional shape perpendicular to the normal line X, the protrusion 23 includes a protrusion horizontal portion 231 formed linearly along the lateral axis Y. The protrusion 23 also includes a pair of protrusion vertical portions 232 extended in the Z1 direction from both lateral ends of the protrusion horizontal portion 231 arranged along the lateral axis Y.

Further, a bottom surface 311*a* of the inner terminal 31 is opposed to a surface of the protrusion lateral portion 231 facing to the Z1 direction along the vertical axis Z. Respective ends of the protrusion lateral portion 231 along the lateral axis Y oppositely protrude from both sides of the terminal first portion 311 along the lateral axis Y.

Further, out of the pair of protrusion vertical portions 232, a protrusion vertical portion 232 facing to the Y1 direction is in close contact with an end face of the terminal first portion 311 facing to the Y1 direction. Out of the pair of protrusion vertical portions 232, a protrusion vertical portion 232 facing to the Y2 direction is in close contact with an end face of the terminal first portion 311 facing to the Y2 direction as well. Further, a surface of the protrusion vertical portion 232 facing to the Z1 direction and a surface of the terminal first portion 311 facing to the Z1 direction are extended on the same plane. An ignition coil unit 1 of this embodiment includes at least one protrusion 23 described heretofore. Remaining configurations employed in this embodiment are substantially the same as employed in the second embodiment.

Figure 11:
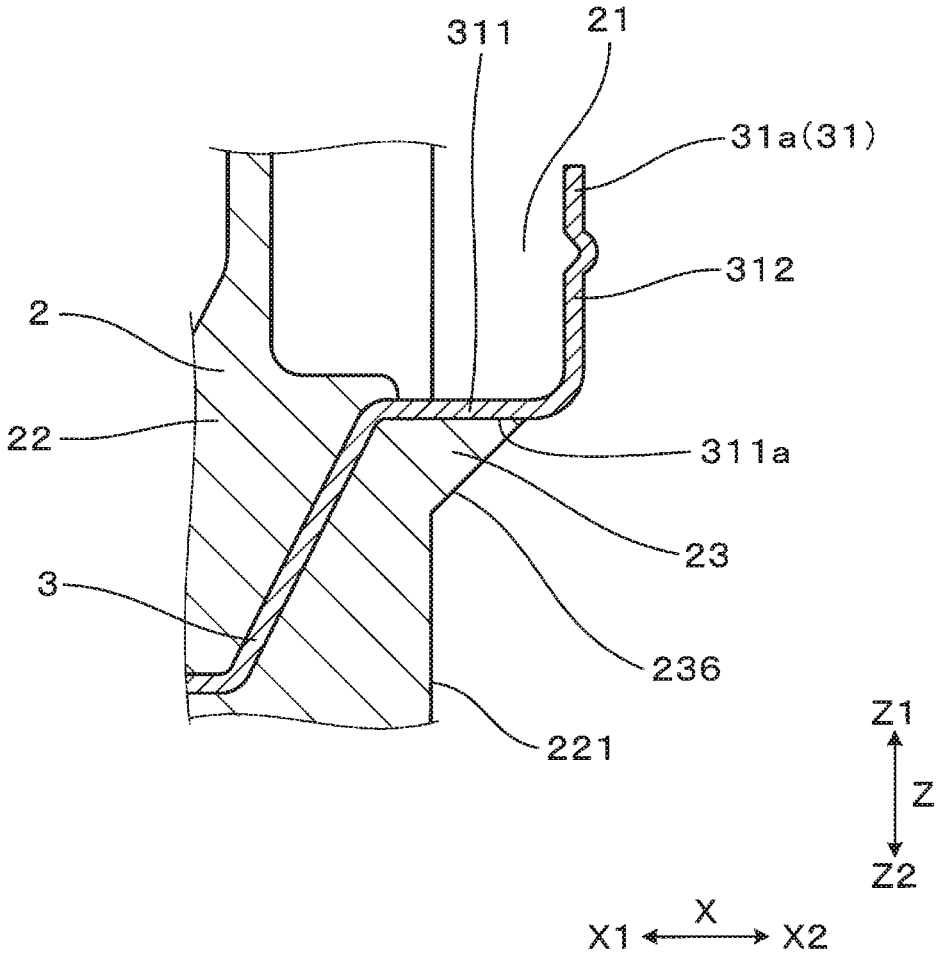
FIG. 11 is an enlarged cross-sectional view illustrating a protrusion and a periphery thereof included in an ignition coil unit according to a fourth embodiment of the present disclosure.

As described heretofore, according to this embodiment, since portions of the protrusion 23 are also opposed to both side ends of the terminal first portion 311 along the lateral axis Y, deformation along the lateral axis Y and twisting of the inner terminal 31 can be suppressed even when a load is applied to the inner terminal 31. The other advantages obtained in this embodiment are substantially the same as obtained in the second embodiment. Now, a fourth embodiment of the present disclosure is described with reference to FIG. 11. As shown in FIG. 11, according to this embodiment, a surface 236 of the protrusion 23 facing to the Z2 direction is inclined. As illustrated, the inclined surface 236 inclines upwardly as it goes to right in the X2 direction.

Further, the inclined surface 236 is connected to a surface of the protrusion 23 facing to the Z1 direction thereby collectively forming a sharp corner. Hence, a thickness of the protrusion 23 along the vertical axis Z increases as it goes downstream in the X1 direction. An ignition coil unit 1 of this embodiment includes at least one protrusion 23 described heretofore. Remaining configurations employed in this embodiment are substantially the same as employed in the second embodiment.

Hence, according to this embodiment, the thickness of the protrusion 23 along the vertical axis Z increases as it goes downstream in the X1 direction. As a result, a rigidity of the protrusion 23 at a root of the protrusion 23, i.e., the end of the protrusion 23 facing to the X1 direction, can be enhanced by securing a connection area between the protrusion 23 and the terminal burying wall main surface 221. At the same time, an amount of resin needed in producing the protrusion 23 can be reduced by reducing the thickness of the protrusion 23 at a portion facing to the X2 direction. The other advantages obtained in this embodiment are substantially the same as obtained in the second embodiment.

Figure 12:
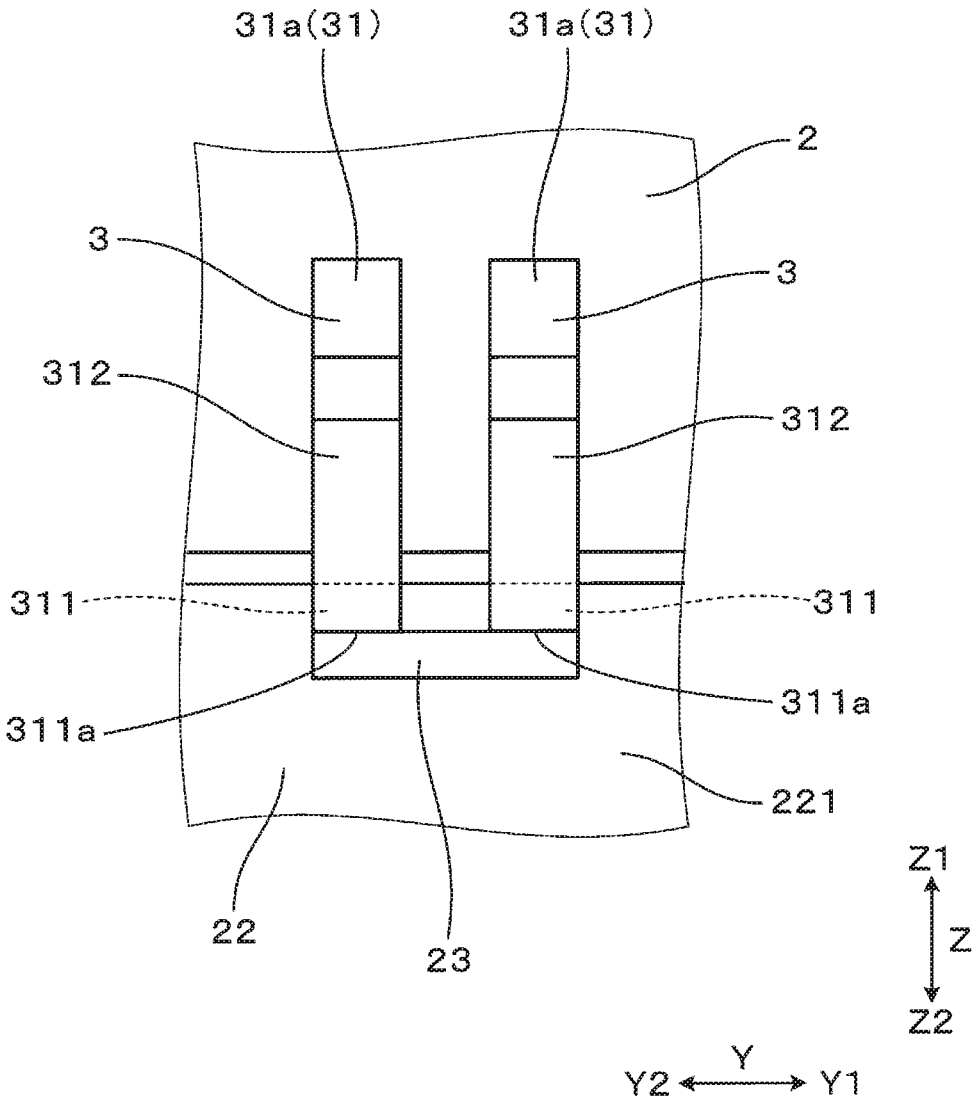
FIG. 12 is an enlarged view illustrating a protrusion and a periphery thereof included in an ignition coil unit according to a fifth embodiment of the present disclosure.

Now, a fifth embodiment of the present disclosure is described with reference to FIG. 12. As shown in FIG. 12, the second embodiment is modified and employed in this embodiment by changing a shape of the protrusion 23.

In this embodiment, a protrusion 23 is extended over respective bottom surfaces 311*a* of terminal first portions 311 of multiple inner terminals 31. Specifically, the protrusion 23 of this embodiment is composed of a rectangular plate having sides extended along the normal line X and the lateral axis Y, respectively, with a given amount of thickness along the vertical axis Z. More specifically, the protrusion 23 faces bottom surfaces 311*a* of two inner terminals 31 arranged adjacent to each other along the lateral axis Y.

Specifically, the protrusion 23 extends along the lateral axis Y over the two inner terminals 31 adjacent to each other along the lateral axis Y. That is, the protrusion 23 extends from an outer side of the terminal first portion 311 of the laterally endmost inner terminal 31 facing to the Y1 direction to an outer side of the terminal first portion 311 of the inner terminal 31 facing to the Y2 direction. An ignition coil unit 1 of this embodiment includes at least one protrusion 23 described heretofore. Remaining configurations employed in this embodiment are substantially the same as employed in the second embodiment.

As described heretofore, according to this embodiment, the protrusion 23 is extended over multiple bottom surfaces 311*a* of respective inner terminals 31. Hence, a single protrusion 23 can face multiple bottom surfaces 311*a* of the respective inner terminals 31. Thus, the number of protrusions 23 can be effectively reduced, and accordingly, a mold for molding a member integral with a protrusion 23 (i.e., the connector unit 10 in this embodiment) can be simplified. Other advantages obtained in this embodiment are substantially the same as obtained in the second embodiment.

Now, a sixth embodiment of the present disclosure is described with reference to FIGS. 13 to 15. Specifically, as shown there, at least one protrusion 23 serves as a cooperative protrusion 233 as described herein below.

Figure 13:
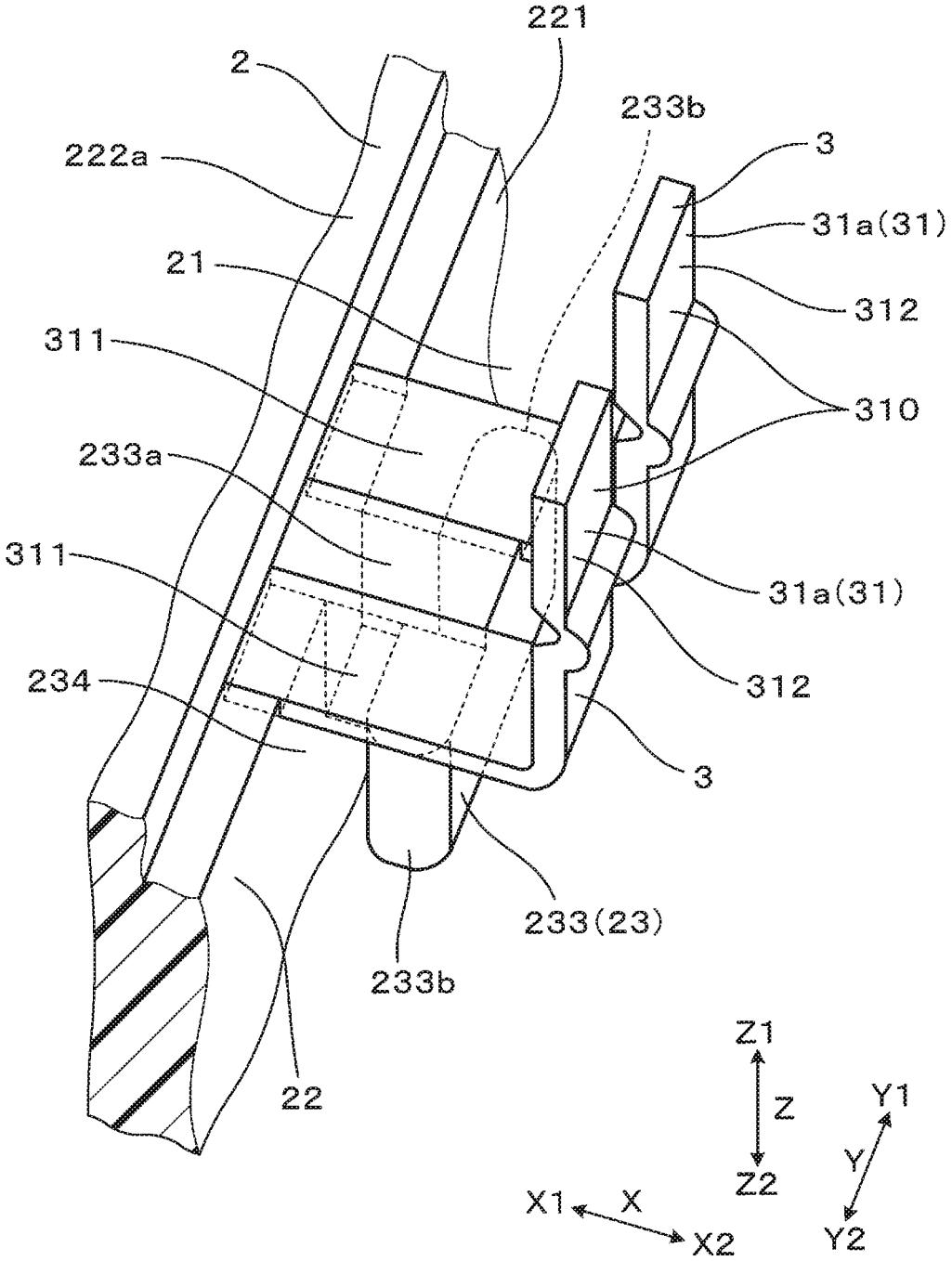
FIG. 13 is a perspective view illustrating a cooperative protrusion and a periphery thereof each included in an ignition coil unit according to a sixth embodiment of the present disclosure.
Figure 14:
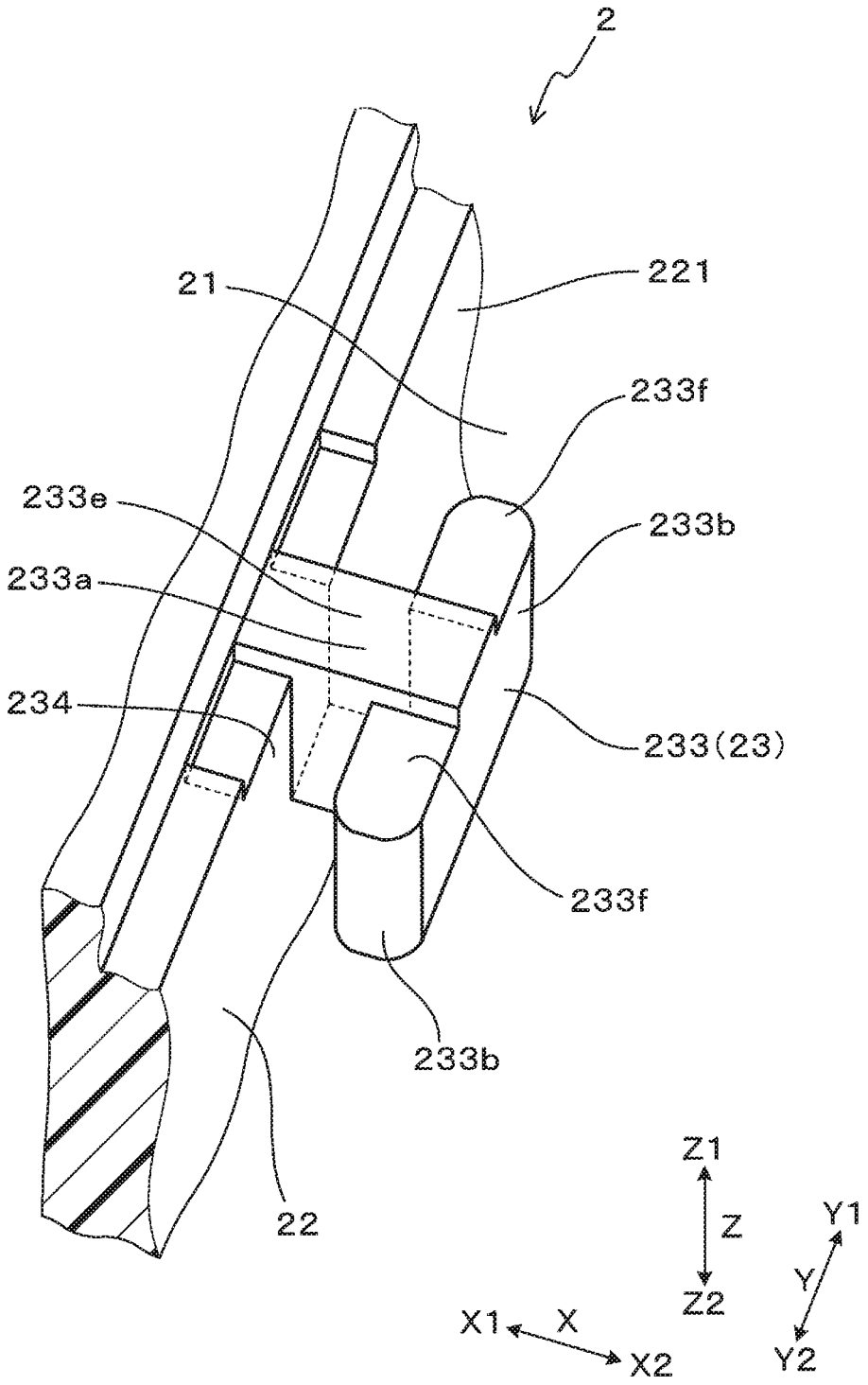
FIG. 14 is a perspective view illustrating a cooperative protrusion and a periphery thereof each included in a housing according to the sixth embodiment of the present disclosure.

As shown in FIG. 14, the cooperative protrusion 233 includes a protrusion first portion 233*a* and a protrusion second portion 233*b*. The protrusion first portion 233*a* is extended along the normal line X in the X2 direction from the terminal burying wall main surface 221. As shown in FIG. 13, the protrusion first portion 233*a* is arranged adjacent to the terminal first portion 311 along the lateral axis Y. That is, the protrusion first portion 233*a* does not face the bottom surface 311*a* of the terminal first portion 311 along the vertical axis Z.

Figure 15:
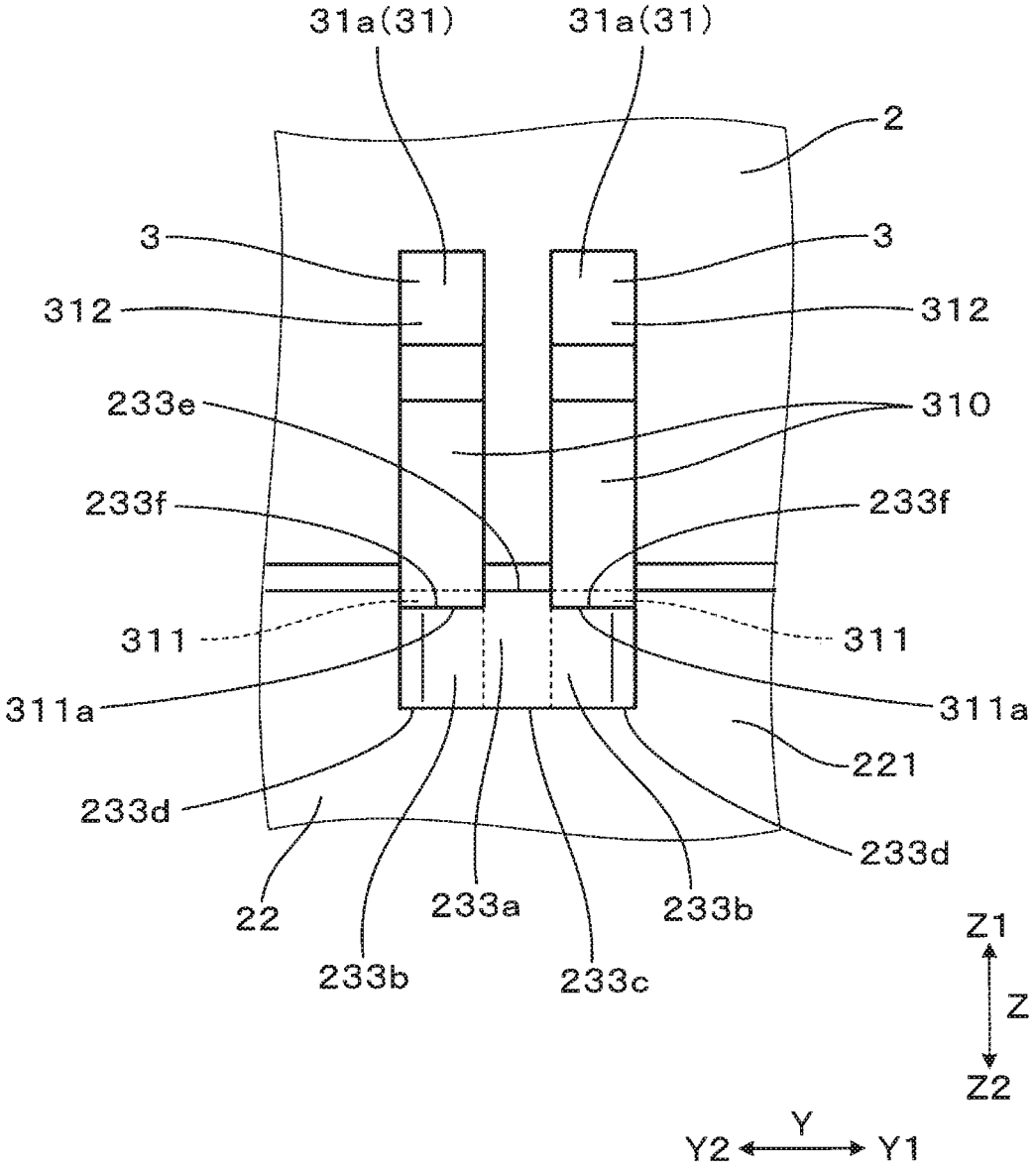
FIG. 15 is an enlarged view illustrating a cooperative protrusion and a periphery thereof each included in an ignition coil unit according to the sixth embodiment of the present disclosure.

Further, as shown in FIGS. 13 to 15, the protrusion second portions 233*b* are extended along the lateral axis Y (in the Y1 and Y2 directions) from the protrusion first portion 233*a*. At least one of the protrusion second portions 233*b* is opposed to the bottom surface 311*a* of the terminal first portion 311 along the vertical axis Z. Further, gaps 234 are formed between the respective protrusion second portions 233*b* and the terminal burying wall main surface 221 along the normal line X.

Further, as shown in FIG. 13, the protrusion first portion 233*a* of the at least one cooperative protrusion 233 is arranged between two adjacent terminal first portions 311 along the lateral axis Y. Herein below, this embodiment is described based on an example in which a single cooperative protrusion 233 is employed. The protrusion first portion 233*a* is disposed between terminal first portions 311 of respective two long terminals 31*a* disposed at a lateral center among the four long terminals 31*a* along the lateral axis Y. These two long terminals 31*a* are herein after sometimes collectively referred to as an adjacent terminal pair 310 in this embodiment. The protrusion first portion 233*a* is extended from the terminal burying wall main surface 221 to almost a middle point of each of the terminal first portions 311 of the adjacent terminal pair 310 along the normal line X.

Further, as shown in FIG. 14, the protrusion second portions 233*b* are extended along the lateral axis Y from both sides of the protrusion first portion 233*a* at the end thereof facing to the X2 direction. Specifically, as shown in FIGS. 13 and 15, one of the protrusion second portions 233*b* facing to the Y1 direction is opposed to one of the bottom surfaces 311*a* of the terminal first portions 311 of the long terminals 31*a* facing to the Y1 direction as a part of the adjacent terminal pair 310. Similarly, one of the protrusion second portions 233*b* facing to the Y2 direction is opposed to one of bottom surfaces 311*a* of the terminal first portions 311 of the long terminals 31*a* facing to the Y2 direction as a part of the adjacent terminal pair 310. That is, the cooperative protrusion 233 is extended over the bottom surfaces 311*a* of the terminal first portions 311 of the respective inner terminals 31.

Further, as shown in FIG. 14, the cooperative protrusion 233 has almost a T-letter shape when viewed from above along the vertical axis Z. Specifically, as shown in FIG. 15, a surface 233*c* of the protrusion first portion 233*a* of the cooperative protrusion 233 facing to the Z2 direction and surfaces 233*d* of the protrusion second portion 233*b* thereof facing to the Z2 direction are laid on the same plane. By contrast, as shown in FIGS. 14 and 15, a surface 233*e* of the protrusion first portion 233*a* facing to the Z1 direction protrudes in the Z1 direction from surfaces 233*f* of the projection second portions 233*b* facing to the Z1 direction. The surface 233*e* of the protrusion first portion 233*a* facing to the Z1 direction and surfaces 311*a* of the respective terminal first portions 311 of the adjacent terminal pair 310 facing to the Z1 direction are laid on the same plane as well. The respective surfaces 233*f* of the respective protrusion second portions 233*b* facing to the Z1 direction are opposed to the bottom surfaces 311*a* of the adjacent terminal pair 310.

Further, as shown in FIGS. 13 and 15, a height of each of the protrusion second portions 233*b* (i.e., a length along the axis Z) is greater than a width of each of the terminal first portions 311 along the lateral axis Y facing the respective protrusion second portions 233*b*. Further, at each of the ends of the pair of protrusion second portions 233*b* respectively facing to the Y1 and Y2 directions, curved corners respectively facing to the X1 and X2 directions are formed to have R-shapes. Respective surfaces 233*f* of the pair of protrusion second portions 233*b* facing to the Z1 direction are extended on the same plane (i.e., level) perpendicular to the vertical axis Z. Further, as shown in FIG. 15, the cooperative protrusion 233 does not protrude outward from both sides of the adjacent terminal pair 310 in the lateral directions Y1 and Y2, respectively. Remaining configurations employed in this embodiment are substantially the same as employed in the second embodiment of the present disclosure.

Hence, as described heretofore, according to this embodiment, at least one protrusion 23 serving as a cooperative protrusion 233 includes the protrusion first portion 233*a* extended along the normal line X, i.e., in the X2 direction from the terminal burying wall main surface 221 and the protrusion second portions 233*b* laterally extended in the opposite directions Y1 and Y2 from the protrusion first portion 233*a*, respectively. Further, the protrusion first portion 233*a* of the cooperative protrusion 233 is located adjacent to the terminal first portion 311 along the lateral axis Y. Furthermore, the protrusion second portions 233*b* are disposed facing the terminal burying wall main surface 221 via the gaps 234 along the normal line X while facing the respective bottom surfaces 311*a*. Hence, while reducing an adhesion area therebetween, the cooperative protrusion 233 is enabled to face the bottom surfaces 311*a* of the terminal first portions 311 of the inner terminal 31. As a result, even when molding shrinkage occurs thereby causing the cooperative protrusion 233 and the terminal burying wall 22 to deform, since it easily peels off from the cooperative protrusion 233, the inner terminal 31 can be prevented from deforming in synchronism with the deformation of the cooperative protrusion 233 and the terminal burying wall 22.

Further, according to this embodiment, the protrusion first portion 233*a* of the at least one cooperative protrusion 233 is arranged between the two adjacent terminal first portions 311 arranged along the lateral axis Y. Further, the protrusion second portions 233*b* are oppositely extended from the respective sides of the protrusion first portion 233*a* in the lateral directions Y1 and Y2 with the protrusion second portions 233*b* facing the bottom surfaces 311*a* of the adjacent terminal pair 310, respectively. Hence, as described above, even when the molding shrinkage occurs in the cooperative protrusion 233 and the terminal burying wall 22, the adjacent terminal pair 310 and the cooperative protrusion 233 are likely to peel off from the other, the adjacent terminal pair 310 can suppress its own deformation. Furthermore, since the single cooperative protrusion 233 is enabled to face the bottom surfaces 311*a* of the adjacent terminal pair 310, a mold for molding a member integral with a cooperative protrusion 233 (i.e., the connector unit 10 in this embodiment) can be effectively simplified. The other advantages obtained in this embodiment are substantially the same as obtained in the second embodiment.

Figure 16:
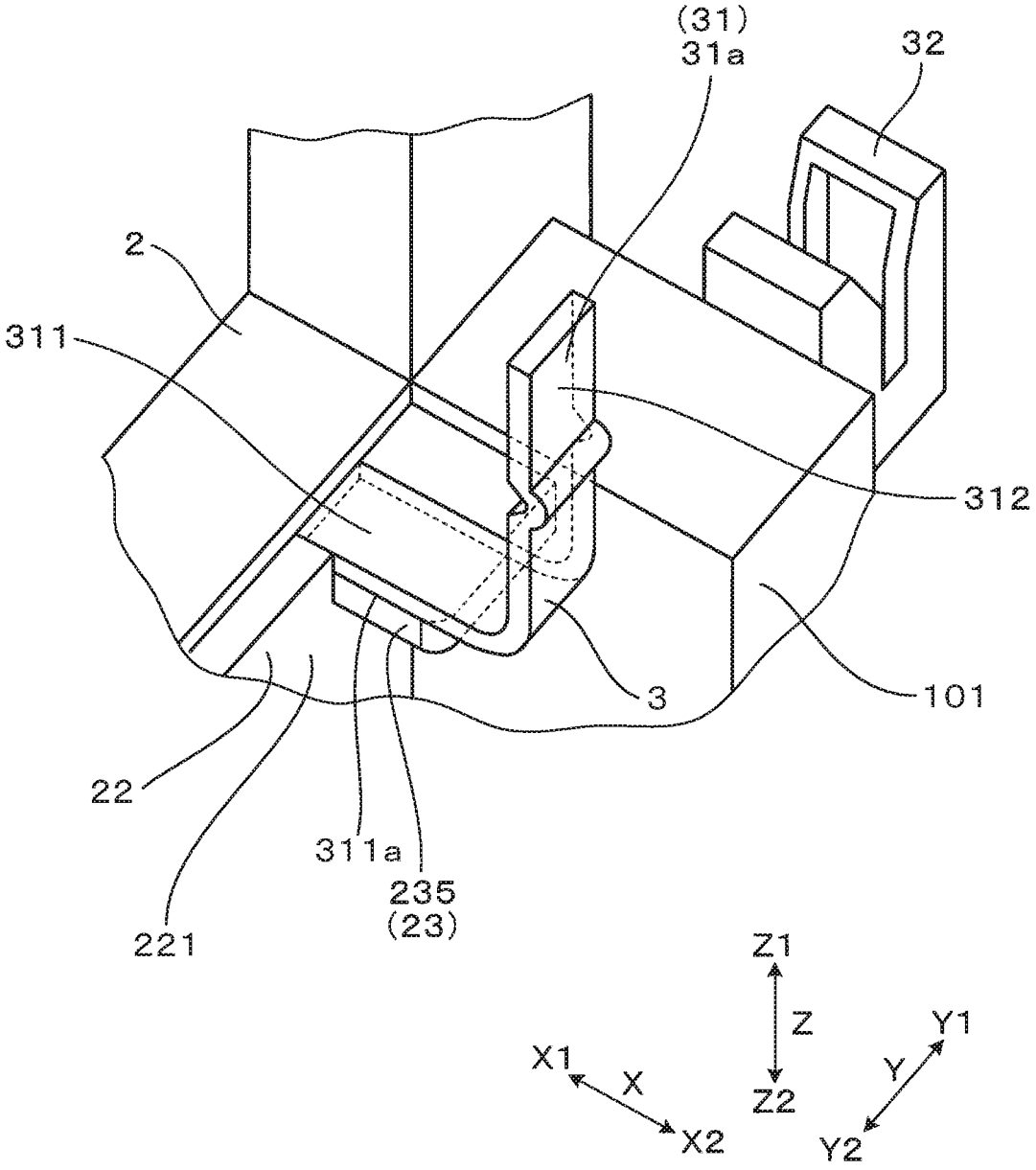
FIG. 16 is a perspective view illustrating a connection protrusion and a periphery thereof each included in an ignition coil unit according to a seventh embodiment of the present disclosure.

Now, a seventh embodiment of the present disclosure is described with reference to FIG. 16. In this embodiment, as shown in FIG. 16, at least one protrusion 23 is connected to both of the linking section 101 and the terminal burying wall 22 to serve as a connection protrusion 235. Hence, in this embodiment, two connection protrusions 235 are provided to connect the pair of linking sections 101 with the terminal burying wall 22, respectively.

Specifically, these connection protrusions 235 face bottom surfaces 311*a* of laterally endmost long terminals 31*a* among the four long terminals 31*a* disposed along the lateral axis Y. In FIG. 16, although only the connection protrusion 235 facing to the Y1 direction is illustrated, the connection protrusion 235 facing to the Y2 has substantially the same but symmetrical structure along the lateral axis Y.

The connection protrusion 235 facing to the Y1 direction is extended from the terminal burying wall main surface 221 in the X2 direction, and in the Y2 direction from a surface facing to the Y2 direction of the linking sections 101 facing to the Y1 direction. Also, the connection protrusion 235 facing to the Y2 direction is extended from the terminal burying wall main surface 221 in the X2 direction, and in the Y1 direction from a surf facing to the Y1 direction of the linking sections 101 facing to the Y2 direction. Accordingly, as shown, each of the connection protrusions 235 is extended in an opposite direction to a direction in which each of the wire connection terminals 32 protrudes, outward from the respective linking sections 101.

Further, a side of each of the connection protrusions 235 facing to the X1 direction is entirely connected to the terminal burying wall 22. A side facing to the Y1 direction of the connection protrusion 235 facing to the Y1 direction is entirely connected to the linking sections 101 facing to the Y1 direction. Similarly, although not illustrated, a side facing to the Y2 direction of the connection protrusion 235 facing to the Y2 direction is entirely connected to the linking sections 101 facing to the Y2 direction.

Further, as illustrated, a side edge facing to the Y2 direction of the terminal first portion 311 of the long terminal 31*a* among the four long terminals 31*a* facing to the Y1 direction is aligned with a side edge facing to the Y2 direction of the connection protrusion 235 facing to the Y1 direction. Similarly, although not illustrated, a side edge facing to the Y1 direction of the terminal first portion 311 of the long terminal 31*a* among the four long terminals 31*a* facing to the Y2 direction is aligned with a side edge facing to the Y1 direction of the connection protrusion 235 facing to the Y2 direction as well.

Further, each of ends of the connection protrusions 235 in the X2 direction is located downstream in the X1 direction of terminal second portions 312 of the long terminals 31*a* having the bottom surfaces 311*a* facing the connection protrusions 235. Each of the connection protrusions 235 is thicker than the long terminal 31*a* facing the connection protrusions 235, respectively. Further, in this embodiment, two cooperative protrusions 233 as described in the sixth embodiment with reference to FIGS. 13 to 15 are arranged to face the two central long terminals 31*a* among the four long terminals 31*a* in the Z2 direction. Remaining configurations employed in this embodiment are substantially the same as employed in the second embodiment of the present disclosure.

Hence, according to this embodiment, since the connection protrusion 235 is enabled to connect with both the terminal burying wall 22 and the linking section 101, the connection protrusion 235 can be effectively strengthened. As a result, deformation and similar problems of the connection protrusion 235 and the inner terminal 31 can be highly probably prevented. The other advantages obtained in this embodiment are substantially the same as obtained in the second and sixth embodiments.

Figure 17:
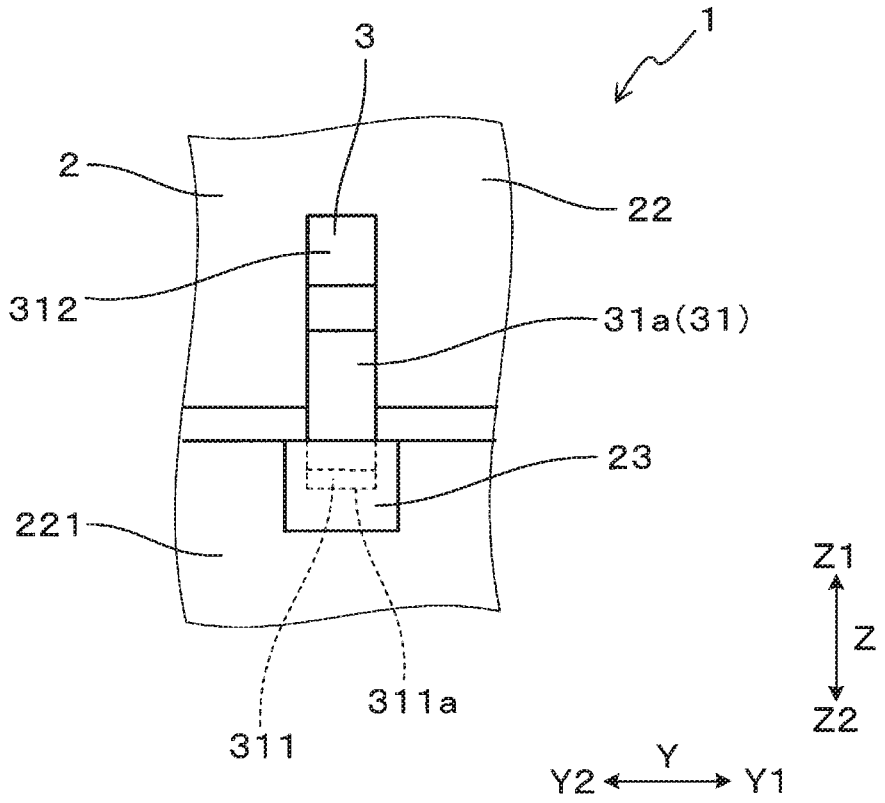
FIG. 17 is an enlarged view illustrating a protrusion and a periphery thereof each included in an ignition coil unit according to an eighth embodiment of the present disclosure.
Figure 18:
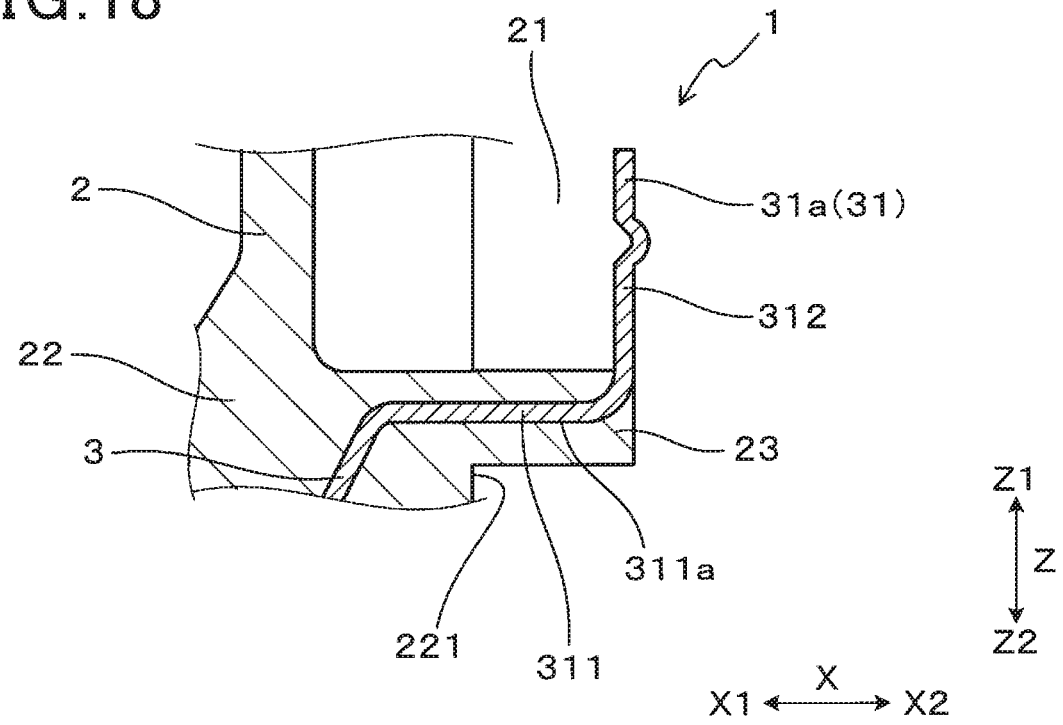
FIG. 18 is an enlarged cross-sectional view illustrating the protrusion and the periphery thereof each included in the ignition coil unit according to the eighth embodiment of the present disclosure.

Now, an eighth embodiment of the present disclosure is described with reference to FIGS. 17 and 18. Specifically, in this embodiment, as shown in FIGS. 17 and 18, a terminal first portion 311 of an inner terminal 31 is entirely buried in a protrusion 23. Specifically, a terminal second portion 312 of the inner terminal 31 protrudes in the Z1 direction from an end of the protrusion 23 facing to the X2 direction. An ignition coil unit 1 of this embodiment includes at least one above-described protrusion 23. Remaining configurations employed in this embodiment are substantially the same as employed in the first embodiment of the present disclosure.

Hence, according to this embodiment, since at least the terminal first portion 311 is entirely buried in the protrusion 23, deformation of the terminal first portion 311 can be suppressed in any direction. The other advantages obtained in this embodiment are substantially the same as obtained in the first embodiment.

Now, a ninth embodiment of the present disclosure is described with reference to FIGS. 19 and 20. Specifically, as shown in FIGS. 19 and 20, the second embodiment is modified and employed in this embodiment by changing the configuration of the housing body 20 and the height of the protrusion 23 along the axis Z.

Figure 19:
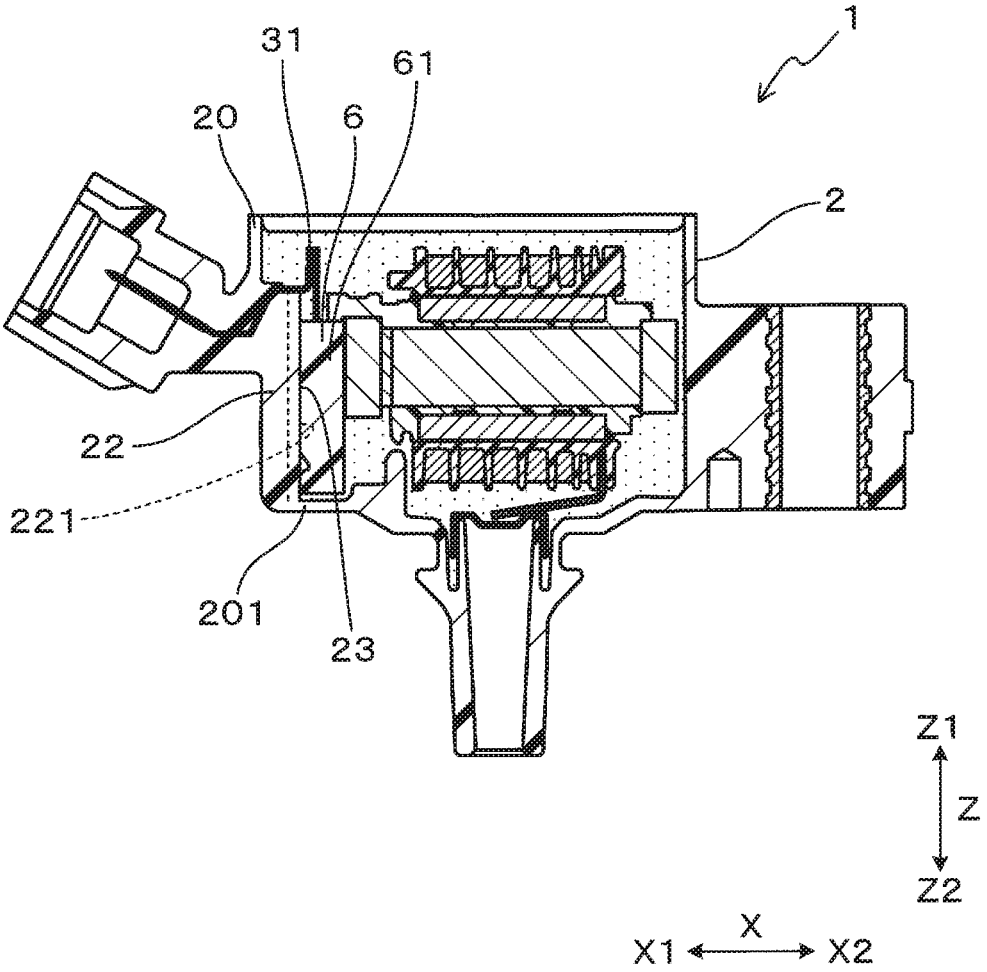
FIG. 19 is a vertical cross-sectional view illustrating an ignition coil unit according to a ninth embodiment of the present disclosure.

As shown in FIG. 19, a housing body 20 and a terminal burying wall 22 are integral. A wall of the housing body 20 facing to the X1 direction constitutes the terminal burying wall 22. A main surface of the terminal burying wall 22 facing to the X1 direction constitutes a terminal burying wall main surface 221.

Figure 20:
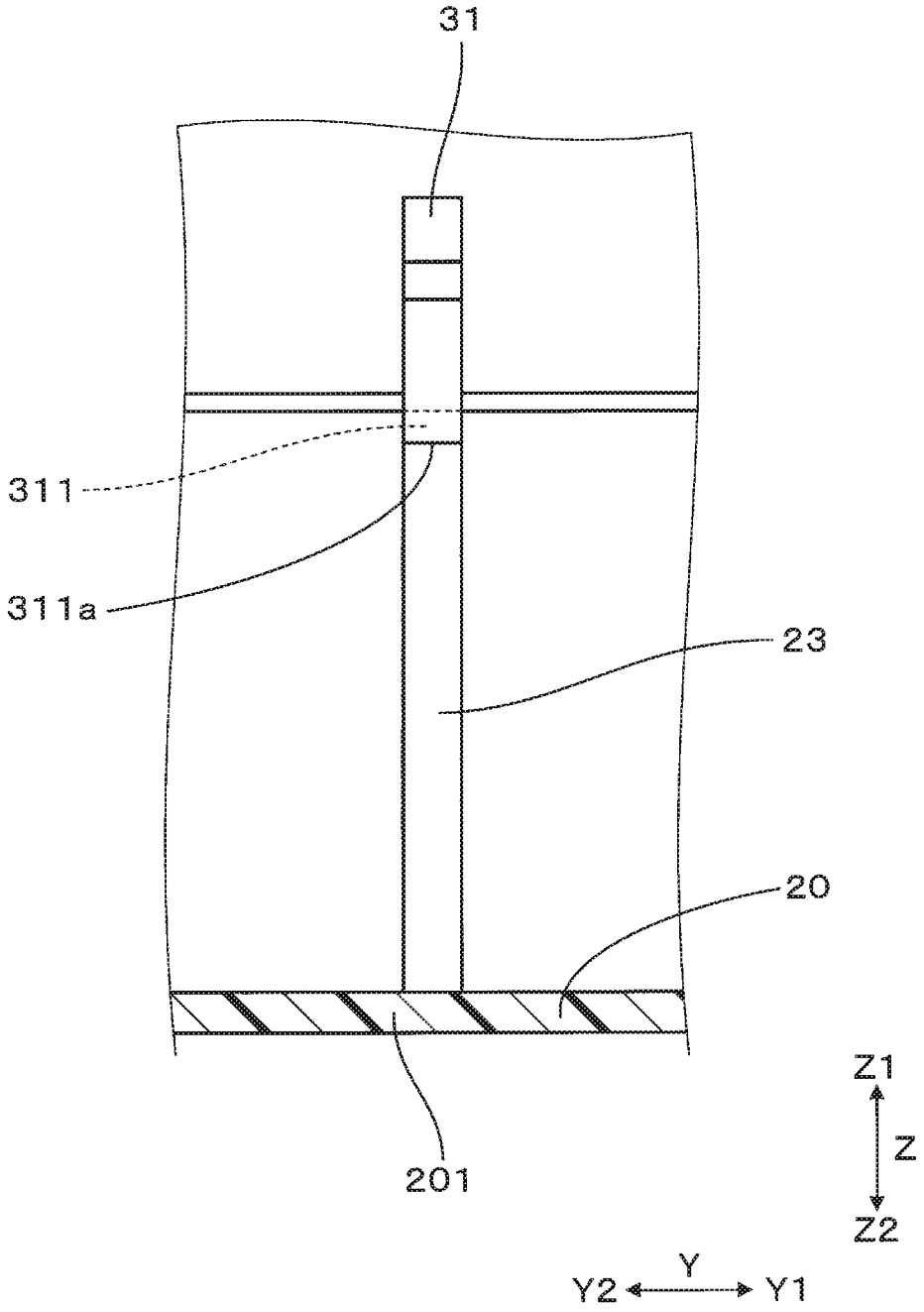
FIG. 20 is an enlarged view illustrating an inner terminal and a vicinity thereof in the housing and the terminal metal part according to the ninth embodiment of the present disclosure.

As shown in FIG. 20, a protrusion 23 is erected along the vertical axis Z from a bottom wall 201 of the housing body 20 until the bottom surface 311*a* of the terminal first portion 311 of the inner terminal 31. Then, the end of the protrusion 23 facing to the Z2 direction is connected to the bottom wall 201 of the housing body 20.

Further, as shown in FIG. 19, a side of the protrusion 23 facing to the X2 direction is in contact with a side of the igniter body 61 facing to the X1 direction. Remaining configurations employed in this embodiment are substantially the same as employed in the second embodiment of the present disclosure.

Hence, according to this embodiment, since the protrusion 23 is vertically erected from the bottom wall 201 of the housing body 20*a* until the bottom surface 311*a* of the terminal first portion 311 of the inner terminal 31, the protrusion 23 can be effectively strengthened.

Further, since the side of the protrusion 23 facing to the X2 direction is in contact with the surface of the igniter body 61 facing to the X1 direction, the protrusion 23 can be used as a positioning device to position the igniter 6 with respect to the housing 2 when the igniter 6 is placed in the housing 2. The other advantages obtained in this embodiment are substantially the same as obtained in the second embodiment.

Numerous additional modifications and variations of the present disclosure are possible in light of the above teachings. It is therefore to be understood that within the scope of the appended claims, the present disclosure may be executed otherwise than as specifically described herein. For example, the ignition coil unit is not limited to the above-described various embodiments and may be altered as appropriate.

What is claimed is:

1. An ignition coil unit comprising:

a primary coil;

a secondary coil magnetically coupled to the primary coil;

an igniter to energize and deenergize the primary coil;

a housing to accommodate the primary coil and the secondary coil in an interior thereof, the housing having a terminal burying wall, the terminal burying wall having a terminal burying wall main surface facing to an interior of the housing; and a terminal metallic part having a first end buried in the terminal burying wall and a second end disposed in the interior of the housing, the second end opposite the first end;

the terminal metallic part including at least one inner terminal at least partially arranged in the interior of the housing, the at least one inner terminal having a terminal first portion extended in a normal line direction of the terminal burying wall main surface from the terminal burying wall main surface toward the interior of the housing, the at least one inner terminal having a terminal second portion continuously extended from a leading end of the terminal first portion in a vertical direction along the terminal burying wall main surface, the at least one inner terminal either press-fit by a terminal of a part installed in the housing or joining the terminal by welding at the terminal second portion, wherein the housing includes at least one protrusion to protrude from the terminal burying wall main surface toward the interior of the housing, the at least one protrusion facing a bottom surface of the at least one terminal first portion in the vertical direction.

2. The ignition coil unit as claimed in claim 1, wherein the at least one protrusion laterally spreads over multiple bottom surfaces of terminal first portions of at least two inner terminals laterally.

3. The ignition coil unit as claimed in claim 1, wherein the at least one protrusion including:

a protrusion first portion extended in the normal line direction from the terminal burying wall main surface toward the interior of the housing; and a protrusion second portion spreading in a lateral direction from a leading end of the protrusion first portion to collectively serve as a cooperative protrusion in association with the protrusion first portion, the lateral direction being perpendicular to both the normal line direction and the vertical direction, wherein the protrusion first portion is disposed adjacent to the at least one terminal first portion in the lateral direction and the protrusion second portion faces the at least one bottom surface, wherein a gap is formed between the protrusion second portion and the terminal burying wall main surface in the normal line direction.

4. The ignition coil unit as claimed in claim 3, wherein the protrusion first portion of the at least one cooperative protrusion is disposed between adjacent two terminal first portions in the lateral direction, wherein the protrusion second portion includes two spreading portions respectively spreading in laterally opposite directions from the end of the protrusion first portion, wherein the two spreading portions face the bottom surfaces of the adjacent two terminal first portions, respectively.

5. The ignition coil unit as claimed in claim 1, further comprising:

a primary spool; and a linking section connected to the primary spool, wherein the primary coil is wound around the primary spool, wherein the terminal burying wall is integral with the primary spool via the linking section, wherein the at least one protrusion is connected to both the terminal burying wall and the linking section.

6. The ignition coil unit as claimed in claim 1, wherein a leading end of the at least one protrusion is recessed in a direction along the normal line from the terminal second portion of the at least one inner terminal.

7. The ignition coil unit as claimed in claim 1, wherein the at least two inner terminals include a short terminal and a long terminal, the long terminal having a longer terminal first portion in the normal line direction than the first terminal first portion of the short terminal, wherein the at least one protrusion faces the bottom surface of the long terminal, and does not face the bottom surface of the short terminal.

* * * * *